US007401602B2

(12) United States Patent
Nakayama et al.

(10) Patent No.: US 7,401,602 B2
(45) Date of Patent: Jul. 22, 2008

(54) METHOD OF ESTIMATING STATE QUANTITY OR TEMPERATURE OF GAS MIXTURE FOR INTERNAL COMBUSTION ENGINE

(75) Inventors: Shigeki Nakayama, Susono (JP); Taku Ibuki, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 63 days.

(21) Appl. No.: 10/571,938

(22) PCT Filed: Sep. 7, 2004

(86) PCT No.: PCT/JP2004/013282

§ 371 (c)(1),
(2), (4) Date: Mar. 15, 2006

(87) PCT Pub. No.: WO2005/028835

PCT Pub. Date: Mar. 31, 2005

(65) Prior Publication Data

US 2007/0044781 A1 Mar. 1, 2007

(30) Foreign Application Priority Data

Sep. 18, 2003 (JP) ..... 2003-326433

(51) Int. Cl.
*F02B 23/00* (2006.01)
*F02D 41/00* (2006.01)

(52) U.S. Cl. ..... 123/585; 123/704

(58) Field of Classification Search ..... 123/435, 123/585, 704; 701/102–105; 73/118.1
See application file for complete search history.

(56) References Cited

U.S. PATENT DOCUMENTS 4,393,702 A * 7/1983 Kohama et al. ..... 73/204.27

(Continued)

FOREIGN PATENT DOCUMENTS

DE 197 40 917 A1 10/1998

(Continued)

OTHER PUBLICATIONS

Y. Wakuri et al; "Studies on the Penetration of Fuel Spray of Diesel Engine"; The Transactions of the Japanese Society of Mechanical Engineers, 1959; pp. 820-826.

*Primary Examiner*—Willis R. Wolfe, Jr.
*Assistant Examiner*—Johnny H. Hoang
(74) *Attorney, Agent, or Firm*—Oliff & Berridge, PLC

(57) ABSTRACT

The present apparatus calculates a mass ma (mass ratio ma/mf) of mixing-gas-forming cylinder interior gas, which is a portion of cylinder interior gas to be mixed with a forefront portion of injected fuel vapor having a mass of mf, on the basis of a predetermined empirical formula. Subsequently, under the assumption that heat exchange with the outside does not occur, the apparatus calculates an adiabatic gas mixture temperature Tmix of the gas mixture forefront portion on the basis of the heat quantity of the fuel vapor having a mass of mf and the heat quantity of the mixing-gas-forming cylinder interior gas having a mass of ma. Subsequently, in consideration of an amount of heat that the gas mixture forefront portion receives from peripheral cylinder interior gas mainly via a circumferential surface thereof, the apparatus estimates a final gas mixture temperature Tmixfin of the gas mixture forefront portion (i.e., the temperature of the gas mixture) in accordance with the equation Tmixfin=Tmix (1−Kex)+Ta Kex, where Ta represents cylinder interior gas temperature, and Kex represents a heat exchange coefficient (0<Kex<1).

8 Claims, 11 Drawing Sheets

U.S. PATENT DOCUMENTS

| | | | | |
|---|---|---|---|---|
| 5,941,927 | A | 8/1999 | Pfitz | |
| 6,035,639 | A | 3/2000 | Kolmanovsky et al. | |
| 6,272,427 | B1 | 8/2001 | Wild et al. | |
| 6,446,618 | B1 * | 9/2002 | Hill | 123/698 |
| 6,588,261 | B1 | 7/2003 | Wild et al. | |
| 2003/0093212 | A1 | 5/2003 | Kotwicki et al. | |

FOREIGN PATENT DOCUMENTS

| | | | |
|---|---|---|---|
| EP | 1 132 608 | A2 | 9/2001 |
| EP | 1 312 784 | A1 | 5/2003 |
| JP | A 09-274507 | | 10/1997 |
| JP | A 11-148412 | | 6/1999 |
| JP | A 11-210539 | | 8/1999 |
| JP | A 2001-20765 | | 1/2001 |
| JP | A 2001-254645 | | 9/2001 |
| JP | A 2001-289092 | | 10/2001 |
| JP | A 2002-54491 | | 2/2002 |
| JP | A 2003-35215 | | 2/2003 |
| JP | 02005048659 | A * | 2/2005 |

* cited by examiner

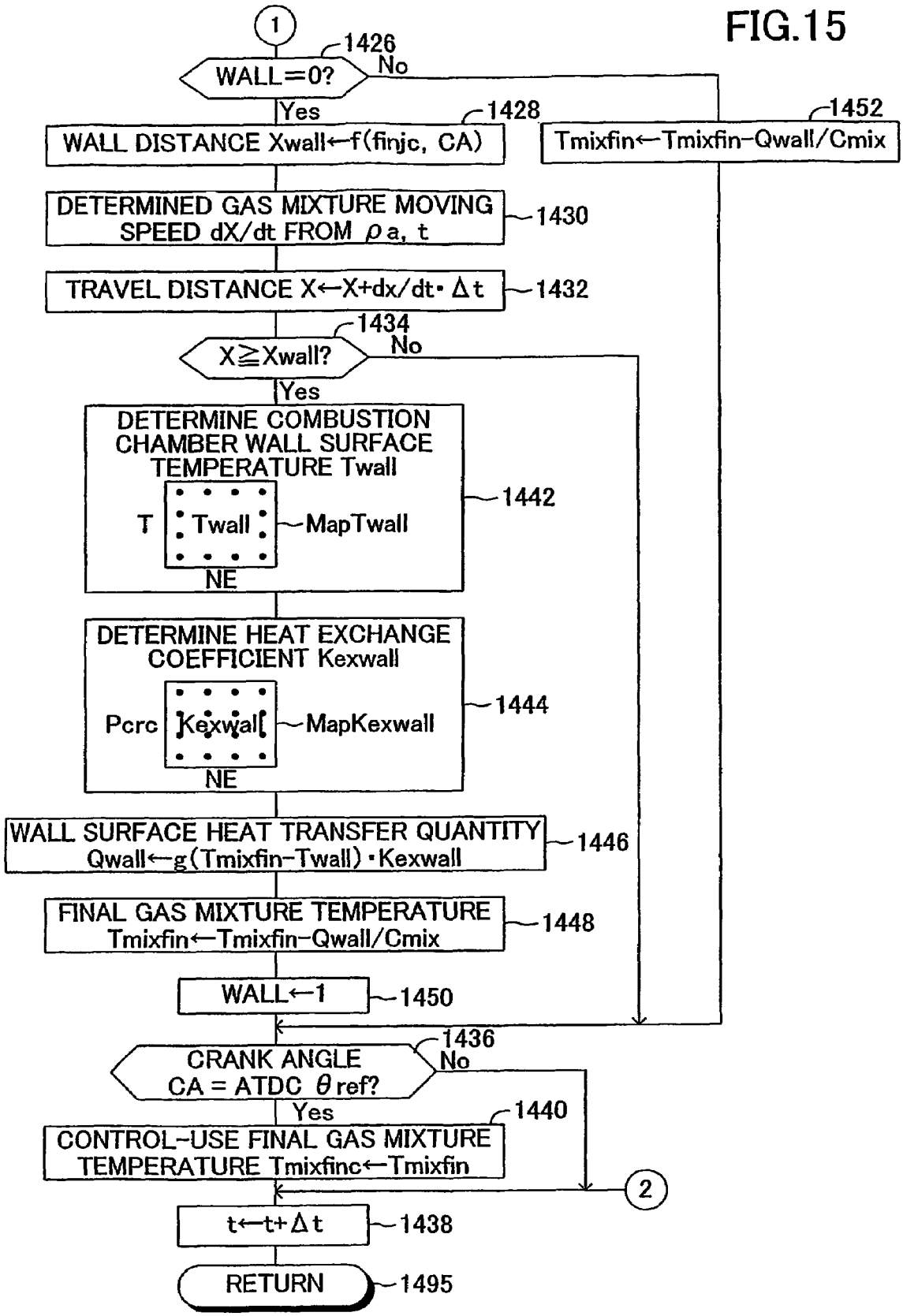
FIG.15
1
WALL=0?
1426
No
Yes
WALL DISTANCE Xwall←f(finjc, CA)
1428
Tmixfin←Tmixfin−Qwall/Cmix
1452
DETERMINED GAS MIXTURE MOVING SPEED dX/dt FROM ρa, t
1430
TRAVEL DISTANCE X←X+dx/dt·Δt
1432
X≧Xwall?
1434
No
Yes
DETERMINE COMBUSTION CHAMBER WALL SURFACE TEMPERATURE Twall
T
Twall
MapTwall
NE
1442
DETERMINE HEAT EXCHANGE COEFFICIENT Kexwall
Pcrc
Kexwall
MapKexwall
NE
1444
WALL SURFACE HEAT TRANSFER QUANTITY Qwall←g(Tmixfin−Twall)·Kexwall
1446
FINAL GAS MIXTURE TEMPERATURE Tmixfin←Tmixfin−Qwall/Cmix
1448
WALL←1
1450
CRANK ANGLE CA = ATDC θref?
1436
No
Yes
CONTROL-USE FINAL GAS MIXTURE TEMPERATURE Tmixfinc←Tmixfin
1440
2
t←t+Δt
1438
RETURN
1495

METHOD OF ESTIMATING STATE QUANTITY OR TEMPERATURE OF GAS MIXTURE FOR INTERNAL COMBUSTION ENGINE

TECHNICAL FIELD

The present invention relates to a gas mixture state-quantity estimation method for an internal combustion engine, which method estimates a state quantity, such as temperature, of a gas mixture produced through mixing of fuel injected into a cylinder of the internal combustion engine and a gas taken into the cylinder.

BACKGROUND ART

The amount of emissions, such as $NO_x$, discharged from an internal combustion engine such as a spark-ignition internal combustion engine or a diesel engine has a strong correlation with the flame temperature (combustion temperature) after ignition. Therefore, controlling the flame temperature to a predetermined temperature effectively reduces the amount of emissions, such as $NO_x$. In general, since flame temperature cannot be detected directly, the flame temperature must be estimated so as to control the flame temperature to the predetermined temperature. Meanwhile, the flame temperature changes depending on the temperature within a cylinder before ignition (hereinafter, may be simply referred to as "cylinder interior temperature"). Accordingly, estimating the cylinder interior temperature is effective for estimation of the flame temperature.

In particular, in the case of a diesel engine in which air-fuel mixture starts combustion by means of self ignition caused by compression, the ignition timing must be properly controlled in accordance with the operating state of the engine. The ignition timing greatly depends on the cylinder interior temperature before ignition. Accordingly, estimation of the cylinder interior temperature is also necessary for proper control of the ignition timing.

In view of the above, a fuel injection apparatus for a diesel engine disclosed in Japanese Patent Application Laid-Open (kokai) No. 2001-254645 sets a target ignition timing in accordance with the operation state of an engine, and estimates a cylinder interior temperature as measured at the target ignition timing on the basis of various operational state quantities which affect the cylinder interior temperature, such as engine coolant temperature, intake air temperature, and intake pressure. Subsequently, the apparatus controls the manner of injection (e.g., injection timing and/or injection pressure) of fuel in such a manner that the estimated cylinder interior temperature attains a predetermined temperature, to thereby control the ignition timing to coincide with the target ignition timing.

Incidentally, strictly speaking, the above-mentioned flame temperature and, therefore, the timing of ignition (by means of self ignition) changes depending on the pre-ignition temperature of a gas mixture produced through mixing of fuel (fuel vapor) present within a cylinder and a gas (new air, EGR gas, etc.) present within the cylinder (hereinafter, the pre-ignition temperature will be referred to as simply the "temperature of gas mixture").

In particular, in the case of an internal combustion engine of a type in which fuel is injected directly to each cylinder, the injected fuel is ignited before it is uniformly mixed with the entirety of gas already taken into the cylinder (hereinafter referred to as "cylinder interior gas"). In other words, at or immediately before an ignition timing, the gas mixture consists of the injected fuel (fuel vapor) and a portion of the cylinder interior gas. Accordingly, at the ignition timing, in the cylinder, the gas mixture occupies one spatial region, and the cylinder interior gas which is present around the gas mixture without being mixed with the fuel (hereinafter may be referred to as "peripheral internal combustion gas") occupies a different spatial region. Since the temperature at the region occupied by the gas mixture (accordingly, the temperature of the gas mixture) naturally differs from that of the peripheral internal combustion gas, the temperature distribution within the cylinder is not uniform.

However, the conventional apparatus estimates the cylinder interior temperature under the assumption that fuel (fuel vapor) is uniformly mixed with the entirety of cylinder interior gas and that a resultant gas mixture is uniformly present within the entire cylinder. Accordingly, the estimated cylinder interior temperature differs from the temperature of the gas mixture itself. As a result, the apparatus fails to accurately control the ignition timing to the target ignition timing. In view of the above, there has arisen desire to accurately estimate the temperature (state quantity) of a gas mixture consisting of injected fuel (fuel vapor) and a portion of cylinder interior gas mixed with the fuel.

DISCLOSURE OF THE INVENTION

In view of the foregoing, an object of the present invention is to provide a gas mixture state-quantity estimation method for an internal combustion engine, which method can accurately estimate a state quantity, such as temperature, of a gas mixture consisting of injected fuel (fuel vapor) and a portion of cylinder interior gas mixed with the fuel.

In a gas mixture state-quantity estimation method for an internal combustion engine according to the present invention, a state quantity of a gas mixture composed of fuel injected into a cylinder of the engine and a portion of cylinder interior gas which is present within the cylinder and which portion mixes with the fuel is estimated by making use of a state quantity of the fuel and a state quantity of the cylinder interior gas.

Under the method of the present invention, the space within the cylinder before ignition is handled as being divided into a portion occupied by the gas mixture and a portion occupied by the peripheral cylinder interior gas; and the state quantity (e.g., temperature) of the portion occupied by the gas mixture (i.e., the state quantity (e.g., temperature) of the gas mixture itself) can be accurately estimated from the temperature, etc. of the injected fuel (fuel vapor) and the temperature, etc. of the cylinder interior gas. Accordingly, through controlling the manner of fuel injection (e.g., injection timing, injection pressure, etc.) in such a manner that the temperature of the gas mixture estimated by the method of the present invention becomes a predetermined temperature (target temperature) at a predetermined timing, flame temperature, ignition timing (by means of self ignition), etc. can be rendered accurately coincident with their target values. As a result, an optimal combustion state can be obtained, whereby the discharge amount of emissions such as $No_x$ can be further reduced.

More specifically, in a gas mixture temperature estimation method for an internal combustion engine according to the present invention, a temperature of the gas mixture composed of fuel injected into a cylinder of the engine and a portion of cylinder interior gas which is present within the cylinder and which portion mixes with the fuel (which portion may be referred to as "mixing-gas-forming cylinder interior gas") is estimated from heat quantity of the injected fuel, heat quantity of the portion of cylinder interior gas, and heat transferred to the gas mixture from the remaining portion of the cylinder interior gas, the remaining portion being present around the gas mixture without mixing with the fuel.

The temperature of the gas mixture consisting of the fuel injected into the cylinder and the mixing-gas-forming cylinder interior gas depends on the heat quantity of the gas mixture; and the heat quantity of the gas mixture depends on the heat quantity of the injected fuel and the heat quantity of the mixing-gas-forming cylinder interior gas. Moreover, in the course of formation of the gas mixture after injection of the fuel, the gas mixture receives heat transferred from the peripheral cylinder interior gas, which is higher in temperature than the gas mixture. Therefore, under the method of the present invention, the temperature of the gas mixture can be estimated more accurately.

In a preferred, more specific method of the present invention, under the assumption that heat exchange with the outside (i.e., peripheral cylinder interior gas, etc.) does not occur in the course of the fuel mixing with the mixing-gas-forming cylinder interior gas, an adiabatic gas mixture temperature is first calculated on the basis of the heat quantity of the injected fuel and the heat quantity of the mixing-gas-forming cylinder interior gas. Subsequently, an amount of heat transferred from the peripheral cylinder interior gas to the gas mixture is obtained by use of the calculated adiabatic gas mixture temperature and the temperature of the cylinder interior gas (peripheral cylinder interior gas); and the temperature of the gas mixture is estimated from the adiabatic gas mixture temperature and the amount of transferred heat. This method enables accurate estimation of the temperature of the gas mixture through simple calculation.

In the gas mixture temperature estimation methods of the present invention, preferably, a travel distance of the gas mixture (as measured from the tip end of an injector) after a point in time when the fuel is injected is obtained; and after the gas mixture hits a combustion chamber wall, the temperature of the gas mixture is estimated in consideration of heat transferred from the gas mixture to the combustion chamber wall.

In general, the temperature of the combustion chamber wall surface is lower than the temperature of the gas mixture. Accordingly, after the gas mixture hits the combustion chamber wall surface, heat is transferred from the gas mixture to the combustion chamber wall surface, with a resultant drop in the gas mixture temperature. Accordingly, under the above-described preferable method, the temperature of the gas mixture can be accurately estimated even after the gas mixture hits the combustion chamber wall surface. As a result, even in the case where the gas mixture ignites after having hit the combustion chamber wall surface, the manner of fuel injection can be properly controlled.

A gas mixture temperature obtaining apparatus for an internal combustion engine according to the present invention, which apparatus is used to practice the gas mixture temperature estimation method of the present invention, comprises gas mixture temperature obtaining means for obtaining a temperature of a gas mixture composed of fuel injected into a cylinder and the above-mentioned gas mixture-forming cylinder interior gas. The gas mixture temperature obtaining means may be means for estimating the temperature of the gas mixture through calculation, or means for physically measuring (detecting) the temperature of the gas mixture by means of a sensor or the like.

The present invention further provides a control apparatus for an internal combustion engine comprising control means for changing an engine control parameter in accordance with the temperature of the gas mixture obtained by means of the gas mixture temperature obtaining means, the engine control parameter being used for controlling the engine. Examples of the engine control parameter include, but are not limited to, fuel injection timing, fuel injection pressure, fuel injection quantity (fuel injection duration), EGR valve opening, and throttle valve opening.

In the control apparatus, the manner of fuel injection (e.g., injection timing, injection pressure, etc.) can be changed in accordance with the temperature of the gas mixture, which is accurately obtained by means of the gas mixture temperature obtaining means, whereby flame temperature, ignition timing (by means of self ignition), etc. can be rendered closely coincident with their target values. As a result, an optimal combustion state can be obtained, whereby the discharge amount of emissions such as $No_x$ can be further reduced.

BRIEF DESCRIPTION OF THE DRAWINGS

FIG. 15 is a flowchart showing the second half of the routine which the CPU shown in FIG. 1 executes so as to calculate gas mixture temperature.

BEST MODE FOR CARRYING OUT THE INVENTION

With reference to the drawings, there will now be described an embodiment of an control apparatus of an internal combustion engine (diesel engine) which includes a gas mixture temperature obtaining apparatus that performs a gas mixture temperature estimation method for an internal combustion engine according to the present invention.

Figure 1:
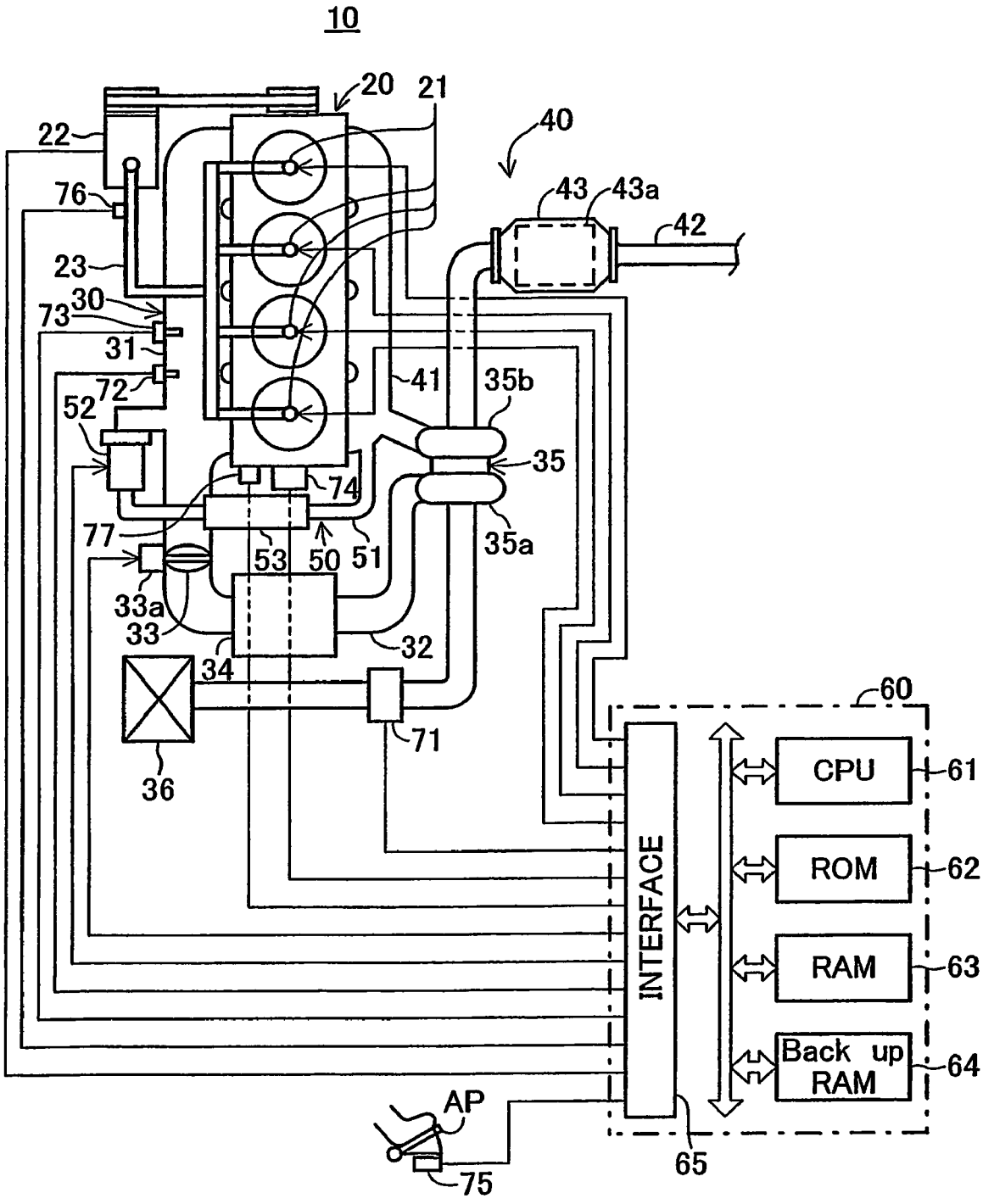
FIG. 1 a schematic diagram showing the entire configuration of a system in which an engine control apparatus according to an embodiment of the present invention is applied to a four-cylinder internal combustion engine (diesel engine).

FIG. 1 schematically shows the entire configuration of a system in which the engine control apparatus according to the present invention is applied to a four-cylinder internal combustion engine (diesel engine) 10. This system comprises an engine main body 20 including a fuel supply system; an intake system 30 for introducing gas to combustion chambers (cylinder interiors) of individual cylinders of the engine main body 20; an exhaust system 40 for discharging exhaust gas from the engine main body 20; an EGR apparatus 50 for performing exhaust circulation; and an electronic control apparatus 60.

Fuel injection valves (injection valves, injectors) 21 are disposed above the individual cylinders of the engine main body 20. The fuel injection valves 21 are connected via a fuel line 23 to a fuel injection pump 22 connected to an unillustrated fuel tank. The fuel injection pump 22 is electrically connected to the electronic control apparatus 60. In accordance with a drive signal from the electronic control apparatus 60 (an instruction signal corresponding to an instruction final fuel injection pressure Pcrfin to be described later), the fuel injection pump 22 pressurizes fuel in such a manner that the actual injection pressure (discharge pressure) of fuel becomes equal to the instruction final fuel injection pressure Pcrfin.

Thus, fuel pressurized to the instruction final fuel injection pressure Pcrfin is supplied from the fuel injection pump 22 to the fuel injection valves 21. Moreover, the fuel injection valves 21 are electrically connected to the electronic control apparatus 60. In accordance with a drive signal (an instruction signal corresponding to an instruction fuel injection quantity qfin) from the electronic control apparatus 60, each of the fuel injection valves 21 opens for a predetermined period of time so as to inject, directly to the combustion chamber of the corresponding cylinder, the fuel pressurized to the instruction final fuel injection pressure Pcrfin, in the instruction fuel injection quantity qfin.

The intake system 30 includes an intake manifold 31, which is connected to the respective combustion chambers of the individual cylinders of the engine main body 20; an intake pipe 32, which is connected to an upstream-side branching portion of the intake manifold 31 and constitutes an intake passage in cooperation with the intake manifold 31; a throttle valve 33, which is rotatably held within the intake pipe 32; a throttle valve actuator 33*a* for rotating the throttle valve 33 in accordance with a drive signal from the electronic control apparatus 60; an intercooler 34, which is interposed in the intake pipe 32 to be located on the upstream side of the throttle valve 33; a compressor 35*a* of a turbocharger 35, which is interposed in the intake pipe 32 to be located on the upstream side of the intercooler 34; and an air cleaner 36, which is disposed at a distal end portion of the intake pipe 32.

The exhaust system 40 includes an exhaust manifold 41, which is connected to the individual cylinders of the engine main body 20; an exhaust pipe 42, which is connected to a downstream-side merging portion of the exhaust manifold 41; a turbine 35*b* of the turbocharger 35 interposed in the exhaust pipe 42; and a diesel particulate filter (hereinafter referred to as "DPNR") 43, which is interposed in the exhaust pipe 42. The exhaust manifold 41 and the exhaust pipe 42 constitute an exhaust passage.

The DPNR 43 is a filter unit which accommodates a filter 43*a* formed of a porous material such as cordierite and which collects, by means of a porous surface, the particulate matter contained in exhaust gas passing through the filter. In the DPNR 43, at least one metal element selected from alkaline metals such as potassium K, sodium Na, lithium Li, and cesium Cs; alkaline-earth metals such as barium Ba and calcium Ca; and rare-earth metals such as lanthanum La and yttrium Y is carried, together with platinum, on alumina serving as a carrier. Thus, the DPNR 43 also serves as a storage-reduction-type $NO_x$ catalyst unit which, after absorption of $NO_x$, releases the absorbed $NO_x$ and reduces it.

The EGR apparatus 50 includes an exhaust circulation pipe 51, which forms a passage (EGR passage) for circulation of exhaust gas; an EGR control valve 52, which is interposed in the exhaust circulation pipe 51; and an EGR cooler 53. The exhaust circulation pipe 51 establishes communication between an exhaust passage (the exhaust manifold 41) located on the upstream side of the turbine 35*b*, and an intake passage (the intake manifold 31) located on the downstream side of the throttle valve 33. The EGR control valve 52 responds to a drive signal from the electronic control apparatus 60 so as to change the quantity of exhaust gas to be circulated (exhaust-gas circulation quantity, EGR-gas flow rate).

The electronic control apparatus 60 is a microcomputer which includes a CPU 61, ROM 62, RAM 63, backup RAM 64, an interface 65, etc., which are connected to one another by means of a bus. The ROM 62 stores a program to be executed by the CPU 61, tables (lookup tables, maps), constants, etc. The RAM 63 allows the CPU 61 to temporarily store data. The backup RAM 64 stores data in a state in which the power supply is on, and holds the stored data even after the power supply is shut off. The interface 65 contains A/D converters.

The interface 65 is connected to a hot-wire-type air flow meter 71, which serves as air flow rate (new-air flow rate) measurement means, and is disposed in the intake pipe 32; an intake temperature sensor 72, which is provided in the intake passage to be located downstream of the throttle valve 33 and downstream of a point where the exhaust circulation pipe 51 is connected to the intake passage; an intake pipe pressure sensor 73, which is provided in the intake passage to be located downstream of the throttle valve 33 and downstream of a point where the exhaust circulation pipe 51 is connected to the intake passage; a crank position sensor 74; an accelerator opening sensor 75; a fuel temperature sensor 76 provided in the fuel pipe 23 in the vicinity of the discharge port of the fuel injection pump 22; and an output torque sensor 77. The interface 65 receives respective signals from these sensors, and supplies the received signals to the CPU 61. Further, the interface 65 is connected to the fuel injection valves 21, the fuel injection pump 22, the throttle valve actuator 33*a*, and the EGR control valve 52; and outputs corresponding drive signals to these components in accordance with instructions from the CPU 61.

The hot-wire-type air flow meter 71 measures the mass flow rate of intake air passing through the intake passage (intake air quantity per unit time, new air quantity per unit time), and generates a signal indicating the mass flow rate Ga (air flow rate Ga). The intake temperature sensor 72 measures the temperature of gas that is taken into each cylinder (i.e., each combustion chamber or cylinder interior) of the engine 10 (i.e., intake temperature), and generates a signal representing the intake temperature Tb. The intake pipe pressure sensor 73 measures the pressure of gas that is taken into each cylinder of the engine 10 (i.e., intake pipe pressure), and generates a signal representing the intake pipe pressure Pb.

The crank position sensor 74 detects the absolute crank angle of each cylinder, and generates a signal representing the crank angle CA and engine speed NE; i.e., rotational speed of the engine 10. The accelerator opening sensor 75 detects an amount by which an accelerator pedal AP is operated, and generates a signal representing the accelerator pedal operated amount Acc. The fuel temperature sensor 76 detects temperature of fuel flowing through the fuel line 23, and generates a signal representing fuel temperature Tcr. The output torque sensor 77 detects the output torque of the crankshaft of the engine 10, and generates a signal representing the output torque T.

Outline of Method for Estimating Gas Mixture Temperature

Figure 2:
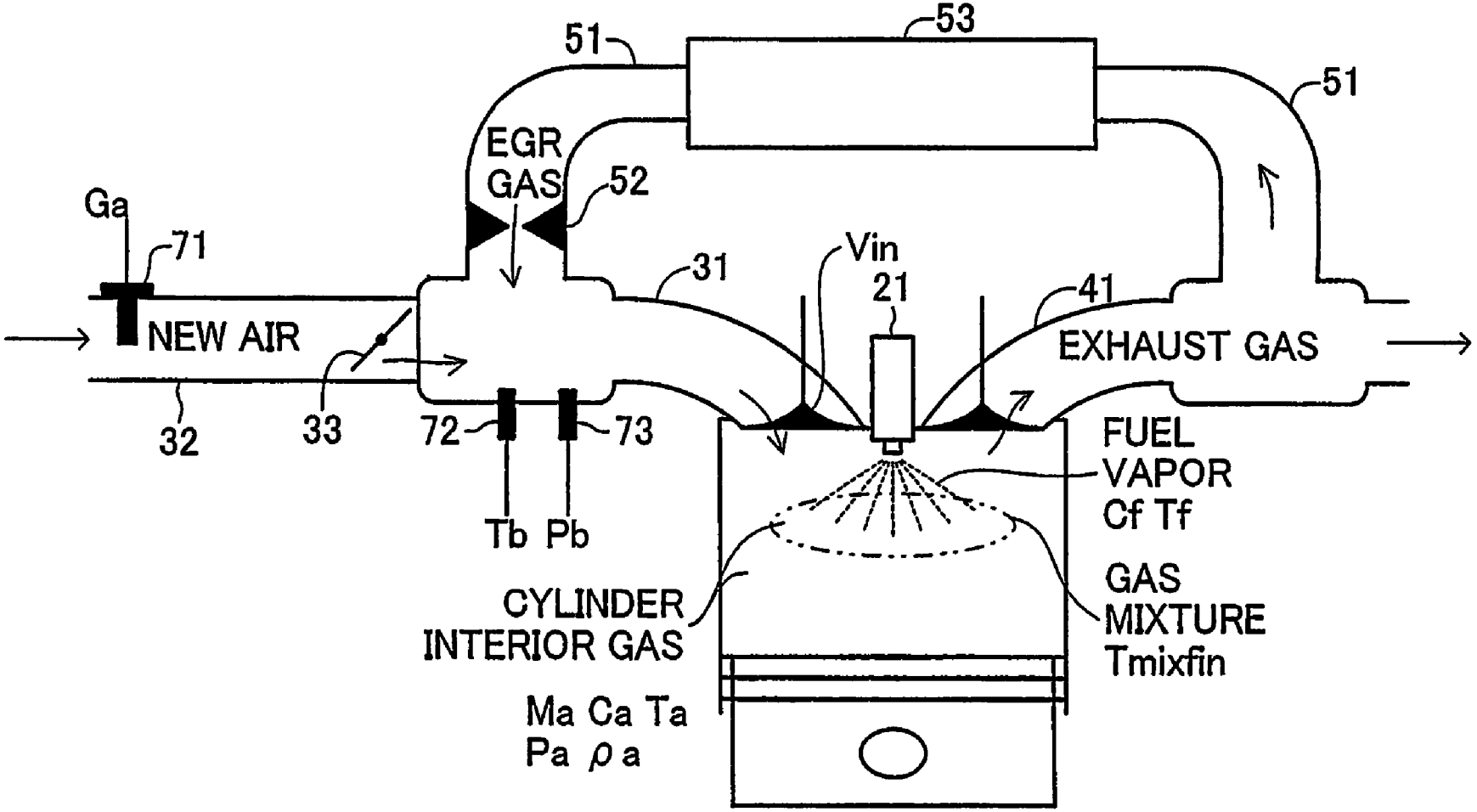
FIG. 2 is a diagram schematically showing a state in which gas is taken from an intake manifold to a certain cylinder and is then discharged to an exhaust manifold.

Next, there will be described a method for estimating gas mixture temperature performed by the control apparatus of the internal combustion engine having the above-described configuration (hereinafter may be referred to as the "present apparatus"). FIG. 2 is a diagram schematically showing a state in which gas is taken from the intake manifold 31 into a certain cylinder (cylinder interior) and is then discharged to the exhaust manifold 41.

As shown in FIG. 2, the gas taken into the cylinder (accordingly, cylinder interior gas) includes new air taken from the tip end of the intake pipe 32 via the throttle valve 33, and EGR gas taken from the exhaust circulation pipe 51 via the EGR control valve 52. The ratio (i.e., EGR ratio) of the quantity (mass) of the taken EGR gas to the sum of the quantity (mass) of the taken new air and the quantity (mass) of the taken EGR gas changes depending on the opening of the throttle valve 33 and the opening of the EGR control valve 52, which are properly controlled by the electronic control apparatus 60 (CPU 61) in accordance with the operating condition.

During an intake stroke, such new air and EGR gas are taken into the cylinder via an opened intake valve Vin as the piston moves downward, and the thus-produced gas mixture serves as cylinder interior gas. The cylinder interior gas is confined within the cylinder when the intake valve Vin closes upon the piston having reached bottom dead center, and then compressed in a subsequent compression stroke as the piston moves upward. When the piston reaches top dead center (specifically, when a final fuel injection timing finjfin to be described later comes), the present apparatus opens the corresponding fuel injection valve 21 for a predetermined period of time corresponding to the instruction fuel injection quantity qfin, to thereby inject fuel directly into the cylinder. As a result, the injected (liquid) fuel immediately becomes fuel vapor, because of heat received from the cylinder interior gas having become hot due to compression. With elapse of time, the fuel vapor disperses conically, while mixing with the cylinder interior gas to produce a gas mixture.

Figure 3:
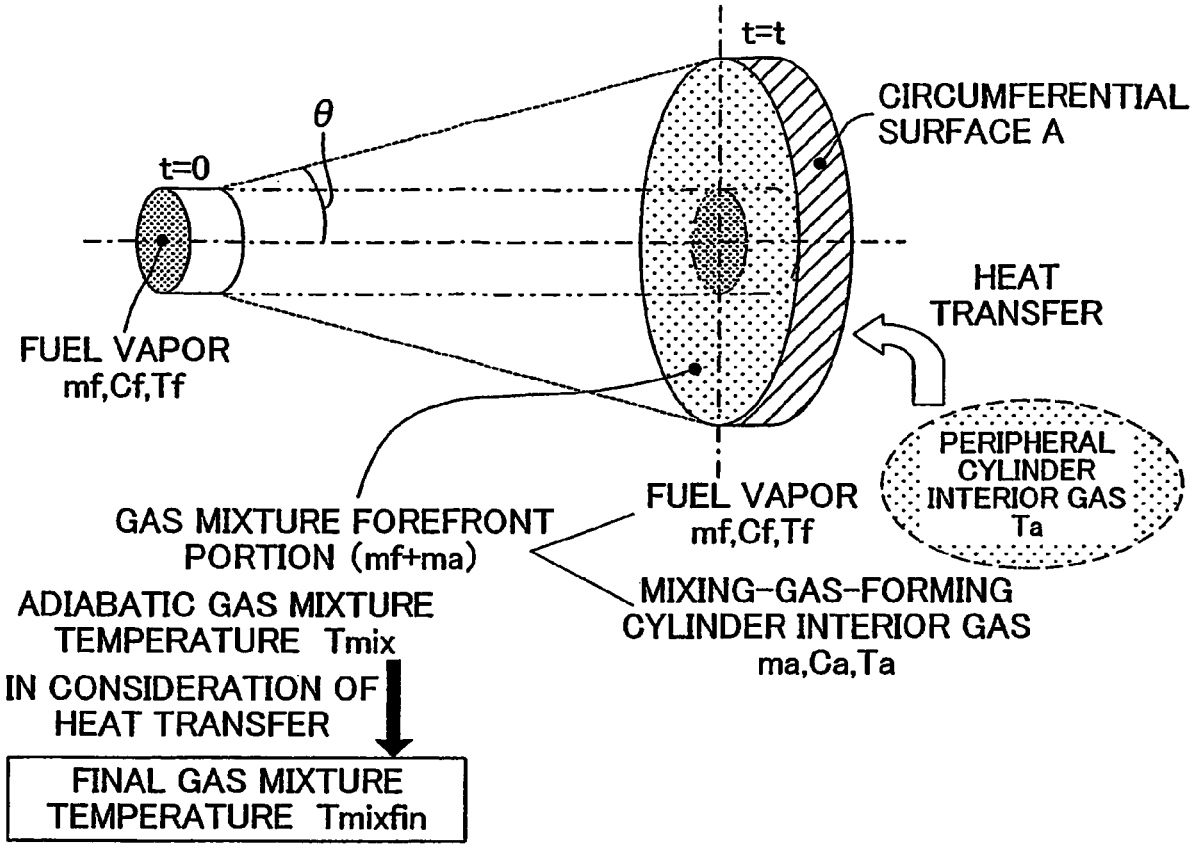
FIG. 3 is a diagram schematically showing a state in which fuel vapor disperses conically while mixing with cylinder interior gas to thereby produce a gas mixture.

FIG. 3 is a diagram schematically showing a state in which fuel vapor disperses conically while mixing with cylinder interior gas to produce a gas mixture. Now, of fuel continuously injected for the predetermined period of time, fuel (fuel vapor) which is present in a forefront portion and has a mass of mf will be considered. After being injected at a fuel injection start time (i.e., post injection time t=0), the fuel vapor whose mass is mf conically disperses at a spray angle θ (see FIG. 3). The fuel vapor is assumed to mix with a cylinder interior gas (i.e., the above-mentioned gas-mixture-forming cylinder interior gas) which has a mass of ma and is a portion of the cylinder interior gas at arbitrary post injection time t, to thereby produce a gas mixture forefront portion (a columnar portion having a circumferential surface A) which has a mass of (mf+ma). The present apparatus estimates temperature of the gas mixture forefront portion as measured at arbitrary post injection time t. First, there will be described a method of obtaining the mass ma of the gas-mixture-forming cylinder interior gas which mixes with the fuel vapor having the mass mf (the ratio (mass ratio) of the mass ma of the gas-mixture-forming cylinder interior gas to the mass mf of the fuel vapor) at arbitrary post injection time t. The mass ma (the ratio of ma to mf) is necessary for estimation of temperature of the gas mixture forefront portion.

<Obtainment of Mass ma of Gas-mixture-forming Cylinder Interior Gas>

In order to obtain the mass ma of the gas-mixture-forming cylinder interior gas as measured at post injection time t, the ratio of the mass ma of the gas-mixture-forming cylinder interior gas to the mass mf of the fuel vapor (i.e., ma/mf) at post injection time t is obtained. Now, an excess air factor λ of the gas mixture forefront portion at post injection time t is defined by the following Equation (1). In Equation (1), stoich represents a stoichiometric air-fuel ratio (e.g., 14.6).

$$\lambda=(ma/mf)/\text{stoich} \tag{1}$$

The excess air factor λ defined as described above can be obtained as a function of post injection time t on the basis of, for example, the following Equation (2) and Equation (3), which are empirical formulas introduced in "Study on Injected Fuel Travel Distance in Diesel Engine," Yutaro WAKURI, Masaru FUJII, Tatsuo AMITANI, and Reijiro TSUNEYA, the Transactions of the Japanese Society of Mechanical Engineers, p820, 25-156 (1959) (hereinafter referred to as Non-Patent Document 1).

$$\lambda = \int \frac{d\lambda}{dt} dt \tag{2}$$

$$\frac{d\lambda}{dt} = \frac{2^{0.25}}{c^{0.25} \cdot d^{0.5} \cdot \rho_f} \cdot \frac{1}{L} \cdot \tan^{0.5}\theta \cdot \rho_a^{0.25} \cdot \Delta P^{0.25} \cdot \frac{1}{t^{0.5}} \tag{3}$$

In Equation (3), t represents the above-mentioned post injection time, and dλ/dt represents fuel dilution ratio, which is a function of post injection time t. Further, c represents a contraction coefficient, d represents the diameter of the injection openings of the fuel injection valves 21, pf represents the density of (liquid) fuel, and L represents a theoretical dilution gas quantity, all of which are constants.

In Equation (3), ΔP represents effective injection pressure, which is a value obtained through subtraction, from the above-mentioned final fuel injection pressure Pcrfin, of cylinder interior gas pressure Pa0 at the injection start time (i.e., post injection time t=0). The cylinder interior gas pressure Pa0 can be obtained in accordance with the following Equation (4) under the assumption that the state of the cylinder interior gas changes adiabatically in the compression stroke (and expansion stroke) after the cylinder interior gas is confined upon the piston having reached bottom dead center (hereinafter referred to as "ATDC-180°").

$$Pa0=P\text{bottom}\cdot(V\text{bottom}/Va0)^{\kappa} \tag{4}$$

In Equation (4), Pbottom represents cylinder interior gas pressure at ATDC-180°. Since the cylinder interior gas pressure is considered to be substantially equal to the intake pipe pressure Pb at ATDC-180°, the value of Pbottom can obtained from the intake pipe pressure Pb detected by means of the intake pipe pressure sensor 73 at ATDC-180°. Vbottom represents cylinder interior volume at ATDC-180°. Va0 represents cylinder interior volume corresponding to a crank angle CA at post injection time t=0. Since cylinder interior volume Va can be obtained as a function Va(CA) of the crank angle CA on the basis of the design specifications of the engine 10, the values of Vbottom and Va0 can be obtained as well. κ represents the specific heat ratio of the cylinder interior gas.

In Equation (3), θ represents the spray angle shown in FIG. 3. Since the spray angle θ is considered to change in accordance with the above-mentioned effective injection pressure ΔP and density ρa0 of the cylinder interior gas at the injection start time (i.e., post injection time t=0), the spray angle θ can be obtained on the basis of a table Mapθ, which defines the relation between cylinder interior gas density ρa0, effective injection pressure ΔP, and spray angle θ. The cylinder interior gas density ρa0 can be obtained through division of the total mass Ma of the cylinder interior gas by the above-mentioned cylinder interior volume Va0 at post injection time t=0. The total mass Ma of the cylinder interior gas can be obtained in accordance with the following Equation (5), which is based on the state equation of gas at ATDC-180°. In Equation (5), Tbottom represents cylinder interior gas temperature at ATDC-180°. Since the cylinder interior gas temperature is considered to be substantially equal to the intake temperature Tb at ATDC-180°, the value of Tbottom can obtained from the intake temperature Tb detected by means of the intake temperature sensor 72 at ATDC-180°. Ra represents the gas constant of the cylinder interior gas.

$$Ma=P\text{bottom}\cdot V\text{bottom}/(Ra\cdot T\text{bottom}) \quad (5)$$

In Equation (3), ρa represents density of the cylinder interior gas at post injection time t and can be obtained as a function of post injection time t through division of the total mass Ma of the cylinder interior gas by the above-mentioned cylinder interior volume Va(CA) at post injection time t.

As described above, the effective injection pressure ΔP and the spray angle θ are first obtained at post injection time t=0; and subsequently, values of the fuel dilution ratio dλ/dt are successively obtained in accordance with Equation (3) and on the basis of post injection time t and cylinder interior gas density ρa, which is a function of post injection time t. The successively obtained values of fuel dilution ratio dλ/dt are integrated with respect to time in accordance with Equation (2), whereby excess air factor λ at post injection time t can be obtained. Upon obtainment of excess air factor λ at post injection time t, mass ratio ma/mf at post injection time t can be obtained from Equation (1).

<Obtainment of Adiabatic Gas Mixture Temperature Tmix>

Upon obtainment of the mass ratio ma/mf at post injection time t, the adiabatic gas mixture temperature Tmix of the gas mixture forefront portion at post injection time t can be obtained. This adiabatic gas mixture temperature Tmix represents the temperature of the gas mixture forefront portion calculated under the assumption that heat exchange with the outside (i.e., the above-mentioned peripheral cylinder interior gas) does not occur in the course of mixture of the fuel vapor having a mass of mf and constituting the gas mixture forefront portion and the mixing-gas-forming cylinder interior gas having a mass of ma. A method of obtaining adiabatic gas mixture temperature Tmix at post injection time t will now be described.

The heat quantity of the fuel vapor having a mass of mf can be expressed by (mf·Cf·Tf), where Cf represents the specific heat of the fuel vapor, and Tf represents the temperature of the fuel vapor. The temperature Tf of the fuel vapor can be expressed by the following Equation (6) in consideration of latent heat Qvapor per unit mass generated when the liquid fuel changes to fuel vapor immediately after injection. In Expression (6), Tcr represents the temperature of liquid fuel detected by means of the fuel temperature sensor 76 at post injection time t=0. αcr is a correction coefficient for taking into consideration a heat loss produced when fuel passes through the fuel pipe 23 from the vicinity of the discharge port of the fuel injection pump 22 to the fuel injection valves 21. In the present example, the temperature Tf of the fuel vapor having a mass of mf is assumed to be constant after post injection time t=0.

$$Tf=\alpha cr\cdot Tcr-Q\text{vapor}/Cf \quad (6)$$

Similarly, the heat quantity of the mixing-gas-forming cylinder interior gas having a mass of ma can be expressed by (ma·Ca·Ta), where Ca represents the specific heat of the cylinder interior gas, and Ta represents the temperature of the cylinder interior gas. The temperature Ta of the cylinder interior gas (i.e., the temperatures of the mixing-gas-forming cylinder interior gas and the peripheral cylinder interior gas) can be obtained as a function of post injection time t in accordance with the following Equation (7) under the assumption that the state of the cylinder interior gas changes adiabatically in the compression stroke (and the expansion stroke).

$$Ta=T\text{bottom}\cdot(V\text{bottom}/Va(CA))^{\kappa-1} \quad (7)$$

Under the assumption that the entire heat quantity discharged from the mixing-gas-forming cylinder interior gas (mass: ma) when the temperature Ta of the mixing-gas-forming cylinder interior gas decreases to the adiabatic gas mixture temperature Tmix is absorbed by the fuel vapor (mass: mf) so as to increase the temperature Tf of the fuel vapor to the adiabatic gas mixture temperature Tmix, the following Equation (8) stands. When Equation (8) is solved for the adiabatic gas mixture temperature Tmix, and rearranged, the following Equation (9) is obtained. Accordingly, when the above-mentioned fuel vapor temperature Tf, cylinder interior gas temperature Ta at post injection time t, and mass ratio ma/mf at post injection time t are obtained in the above-described manner, the adiabatic gas mixture temperature Tmix of the gas mixture forefront portion at post injection time t can be obtained from Equation (9).

$$ma\cdot Ca\cdot(Ta-T\text{mix})=mf\cdot Cf\cdot(T\text{mix}-Tf) \quad (8)$$

$$T\text{mix}=(Cf\cdot Tf+(ma/mf)\cdot Ca\cdot Ta)/(Cf+(ma/mf)\cdot Ca) \quad (9)$$

<Consideration of Heat Transfer from Peripheral Cylinder Interior Gas>

As described above, the adiabatic gas mixture temperature Tmix represents the temperature of the gas mixture forefront portion calculated under the assumption that no heat is exchanged with the above-mentioned peripheral cylinder interior gas. However, in actuality, during the course of mixture between the fuel vapor and the mixing-gas-forming cylinder interior gas, the gas mixture forefront portion receives, mainly via its circumferential surface A (see FIG. 3), heat which is transferred from the peripheral cylinder interior gas whose temperature Ta is higher than the temperature of the gas mixture forefront portion. As a result, the actual temperature of the gas mixture forefront portion (hereinafter referred to as the "final gas mixture temperature Tmixfin") is higher than the adiabatic gas mixture temperature Tmix by a temperature corresponding to the transferred heat.

On the basis of the above knowledge, the final gas mixture temperature Tmixfin at post injection time t can be obtained on the basis of the following Equation (10), into which a heat exchange coefficient Kex (0<Kex<1) is introduced, and which uses the adiabatic gas mixture temperature Tmix at post injection time t and the temperature of the peripheral cylinder interior gas at post injection time t (i.e., the temperature Ta of the cylinder interior gas).

$$Tmixfin = Tmix \cdot (1 - Kex) + Ta \cdot Kex \quad (10)$$

In Equation (10), the value of the heat exchange coefficient Kex may be constant or may be changed in accordance with, for example, engine speed NE. In the case where the value of the heat exchange coefficient Kex is changed in accordance with the engine speed NE, the value of the heat exchange coefficient Kex is preferably set such that the greater the engine speed NE, the smaller the value of the heat exchange coefficient Kex. The setting is performed because the greater the engine speed NE, the shorter the period during which the above-mentioned heat transfer is effected, with the result that the quantity of transferred heat reduces, and the final gas mixture temperature Tmixfin approaches the adiabatic gas mixture temperature Tmix.

In the above-described manner, the final gas mixture temperature Tmixfin of the gas mixture forefront portion at post injection time t can be obtained. Every time fuel is injected into a cylinder (hereinafter referred to as "fuel injection cylinder"), the present apparatus successively obtains (estimates) the final gas mixture temperature Tmixfin of the gas mixture forefront portion, which is a function of post injection time t, after the fuel injection start time (accordingly, post injection time t=0).

Figure 4:
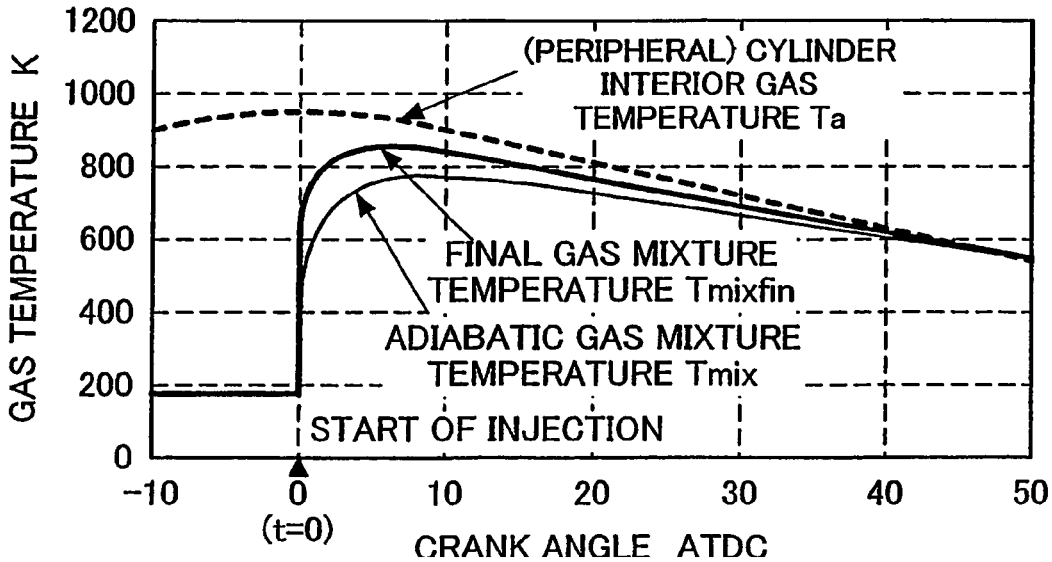
FIG. 4 is a graph showing example changes with time in peripheral cylinder interior gas temperature, adiabatic gas mixture temperature of a gas mixture forefront portion, and final gas mixture temperature of the gas mixture forefront portion, as calculated by the present control apparatus.

FIG. 4 is a graph showing example changes with time in the peripheral cylinder interior gas temperature Ta, the adiabatic gas mixture temperature Tmix of the gas mixture forefront portion, and the final gas mixture temperature Tmixfin of the gas mixture forefront portion, as calculated by the present control apparatus for the case where fuel injection is started at ATDC0° (according, the case where ATDC0° corresponds to post injection time t=0). As shown in FIG. 4, the adiabatic gas mixture temperature Tmix (accordingly, the final gas mixture temperature Tmixfin) approaches the peripheral cylinder interior gas temperature Ta with elapse of time after the fuel injection start time.

This phenomenon occurs for the following reason. That is, since the fuel dilution ratio dλ/dt obtained from Equation (3) always assumes a positive value, the excess air factor λ obtained from Equation (2) increases with post injection time t. Thus, as can be understood from Equation (1), the mass ratio (ma/mf) increases with post injection time t. As a result, as can be understood from Equation (9), the adiabatic gas mixture temperature Tmix approaches the peripheral cylinder interior gas temperature Ta with post injection time t. This corresponds to the phenomenon that as injected fuel vapor (its forefront portion) disperses spirally, the volume of cylinder interior gas to be mixed with the fuel vapor at the gas mixture forefront portion (accordingly, mixing-gas-forming cylinder interior gas) increases.

<State after Gas mixture Forefront Portion Hits Wall Surface of Combustion Chamber>

Figure 5:
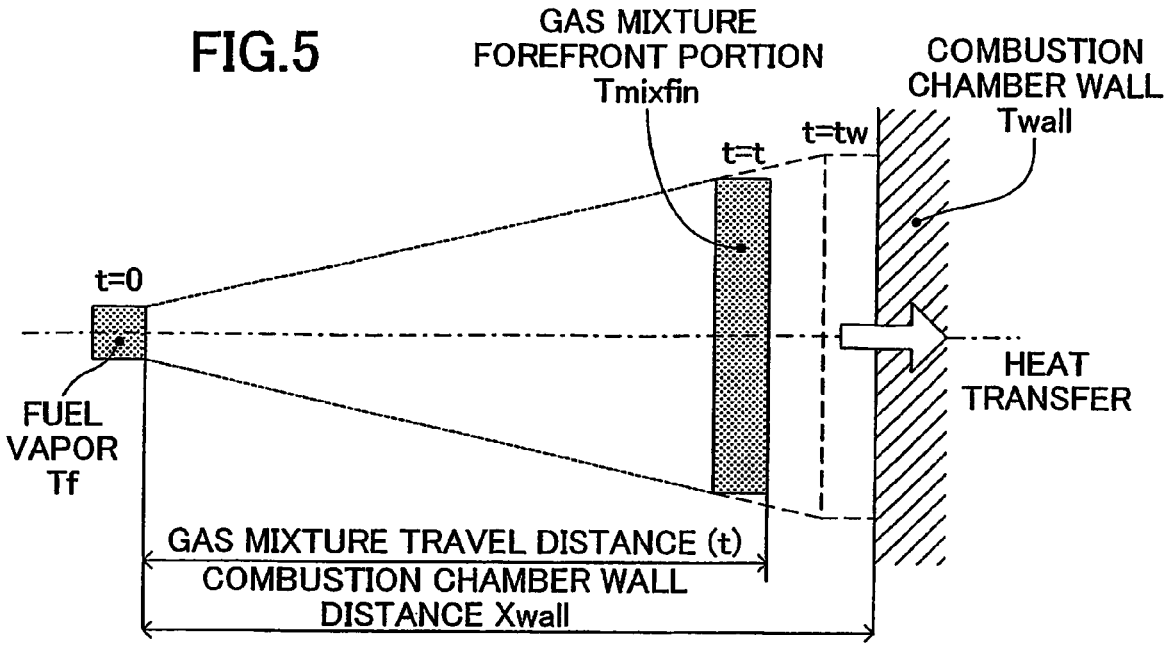
FIG. 5 is a diagram schematically showing a state immediately before a gas mixture forefront portion moving within a cylinder (combustion chamber) hits a wall surface of the combustion chamber.

As shown in FIG. 5, when a predetermined period of time elapses after the injection start time (post injection time t=tw in FIG. 5), the gas mixture forefront portion moving within the cylinder (combustion chamber) hits the combustion chamber wall surface (i.e., the wall surface of the cylinder or the top surface of the piston). In general, the temperature Twall of the combustion chamber wall surface is lower than the temperature of the gas mixture forefront portion (i.e., the final gas mixture temperature Tmixfin). Accordingly, after the gas mixture forefront portion hits the combustion chamber wall surface, heat is transferred from the gas mixture forefront portion to the combustion chamber wall, with the result that the temperature of the gas mixture forefront portion becomes lower than the final gas mixture temperature Tmixfin obtained from Equation (10) by a temperature corresponding to the transferred heat.

Here, the traveling distance over which the gas mixture forefront portion travels from the injection opening of the corresponding fuel injection valve 21 after the injection start time (hereinafter referred to as "gas mixture travel distance X"; see FIG. 5) can be obtained as a function of post injection time t on the basis of, for example, the following Equation (11) and Equation (12), which are experimental formulas introduced in the above-mentioned Non-Patent Document 1. In Equation (12), dX/dt represents gas mixture moving speed, which is a function of post injection time t. Notably, various values shown in the right side of Equation (12) are identical with those shown in the right side of Equation (3).

$$X = \int \frac{dX}{dt} dt \quad (11)$$

$$\frac{dX}{dt} = \frac{1}{2} \cdot \left(\frac{2c \cdot \Delta P}{\rho_a}\right)^{0.25} \cdot \left(\frac{d}{\tan\theta}\right)^{0.5} \cdot \frac{1}{t^{0.5}} \quad (12)$$

That is, values of the gas mixture moving speed dX/dt are successively obtained in accordance with Equation (12) and on the basis of post injection time t and cylinder interior gas density ρa, which is a function of post injection time t. The successively obtained values of the gas mixture moving speed dX/dt are integrated with respect to time in accordance with Equation (11), whereby the gas mixture travel distance X at post injection time t can be obtained.

Also, the distance from the injection opening of the corresponding fuel injection valve 21 to the combustion chamber wall surface (hereinafter referred to as "combustion chamber wall distance Xwall"; see FIG. 5) changes in accordance with fuel injection start time (specifically, final fuel injection timing finjfin to be described later) and crank angle CA (accordingly, post injection time t). Therefore, the combustion chamber wall distance Xwall can be obtained as a function of these values.

Moreover, the quantity of heat (per unit mass) transferred from the gas mixture forefront portion to the combustion chamber wall surface (wall surface heat transfer quantity Qwall) can be represented by the following Equation (13) from the above-mentioned final gas mixture temperature Tmixfin and combustion chamber wall surface temperature Twall. In Equation (13), a function g is a function such that the greater the difference (Tmixfin−Twall) between the final gas mixture temperature Tmixfin and the combustion chamber wall surface temperature Twall, the greater the value of the function. Kexwall is a heat exchange coefficient, which may be constant or which may change in accordance with, for example, engine speed NE and/or fuel injection pressure.

$$Qwall - g(Tmixfin - Twall) \cdot Kexwall \quad (13)$$

Accordingly, upon obtainment of the wall surface heat transfer quantity Qwall from Equation (13), the temperature drop of the gas mixture forefront portion due to the above-described heat transfer can be obtained through calculation of (Qwall/Cmix), where Cmix represents the specific heat of the gas mixture.

Therefore, after the injection start time, the present apparatus successively obtains the gas mixture travel distance X and the combustion chamber wall distance Xwall in the above-described method; and, when the condition "gas mixture travel distance X≧combustion chamber wall distance Xwall" is satisfied, the present apparatus determines that the gas mixture forefront portion has hit the combustion chamber wall surface. After that point of time, the present apparatus corrects the final gas mixture temperature Tmixfin, which is obtained from Equation (10), in accordance with the following Equation (14).

$$Tmixfin=Tmixfin-Qwall/Cmix \quad (14)$$

Figure 6:
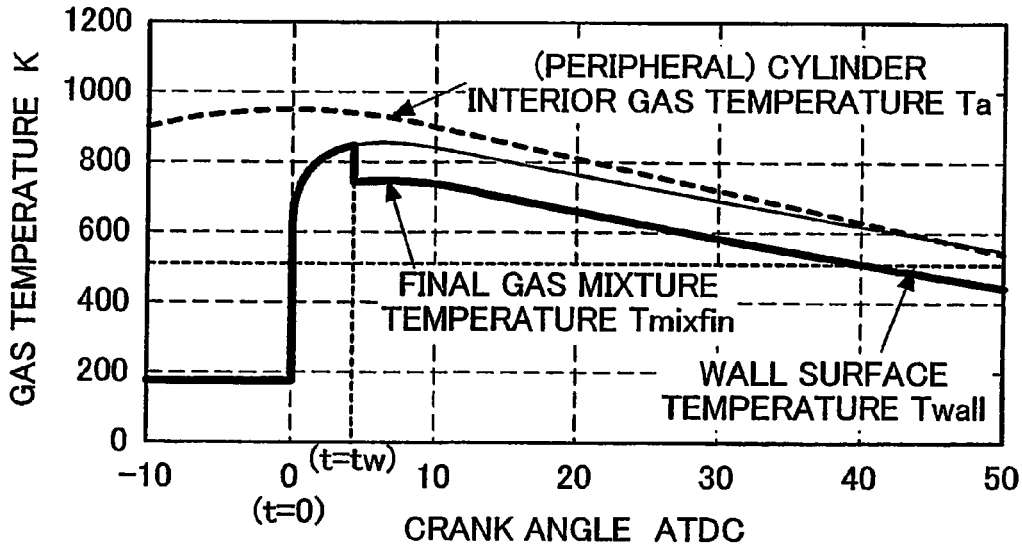
FIG. 6 is a graph showing example changes with time in peripheral cylinder interior gas temperature and final gas mixture temperature of the gas mixture forefront portion, as calculated by the present control apparatus in consideration of the fact that the gas mixture forefront portion hits a wall surface of the combustion chamber after start of fuel injection.

FIG. 6 is a graph showing example changes with time in the peripheral cylinder interior gas temperature Ta and the final gas mixture temperature Tmixfin of the gas mixture forefront portion, as calculated by the present control apparatus for the case where fuel injection is started under the same condition as in the case of FIG. 4 and the gas mixture forefront portion hits the combustion chamber wall surface when the crank angle CA is at about ATDC4°, which corresponds to post injection time t=tw. As shown in FIG. 6, after post injection time t=tw, the final gas mixture temperature Tmixfin is calculated to be lower than the original value by the value of (Qwall/Cmix), which is a constant value. The above is the outline of the method for estimating the temperature of gas mixture.

Outline of Fuel Injection Control

The present apparatus sets the target ignition timing to a predetermined timing (ATDCθref; e.g., ATDC10°). Subsequently, in order to render the ignition timing of gas mixture (its forefront portion) coincident with the target ignition timing ATDCθref, the present apparatus feedback-controls the fuel injection start timing and the fuel injection pressure in such a manner that the final gas mixture temperature Tmixfin obtained when the crank angle CA reaches ATDCθref (hereinafter referred to as "control-use final gas mixture temperature Tmixfinc") becomes a predetermined target gas mixture temperature Tmixref.

Specifically, when the control-use final gas mixture temperature Tmixfinc obtained for the previous fuel injection cylinder is higher than the target gas mixture temperature Tmixref, the present apparatus delays the fuel injection start timing for the current fuel injection cylinder by a predetermined amount from a base fuel injection timing, and decreases the fuel injection pressure by a predetermined amount from a base fuel injection pressure. Thus, control is performed to decrease the actual gas mixture temperature of the current fuel injection cylinder at the target ignition timing ATDCθref. As a result, the actual ignition timing of the current fuel injection cylinder is made coincident with the target ignition timing ATDCθref.

Meanwhile, when the control-use final gas mixture temperature Tmixfinc obtained for the previous fuel injection cylinder is lower than the target gas mixture temperature Tmixref, the present apparatus advances the fuel injection start timing for the current fuel injection cylinder by a predetermined amount from the base fuel injection timing, and increases the fuel injection pressure by a predetermined amount from the base fuel injection pressure. Thus, control is performed to increase the actual gas mixture temperature of the current fuel injection cylinder at the target ignition timing ATDCθref. As a result, the actual ignition timing of the current fuel injection cylinder is made coincident with the target ignition timing ATDCθref. The above is the outline of fuel injection control.

Actual Operation

Next, actual operations of the control apparatus of the engine having the above-described configuration will be described.

<Control of Fuel Injection Quantity Control, Etc.>

Figure 7:
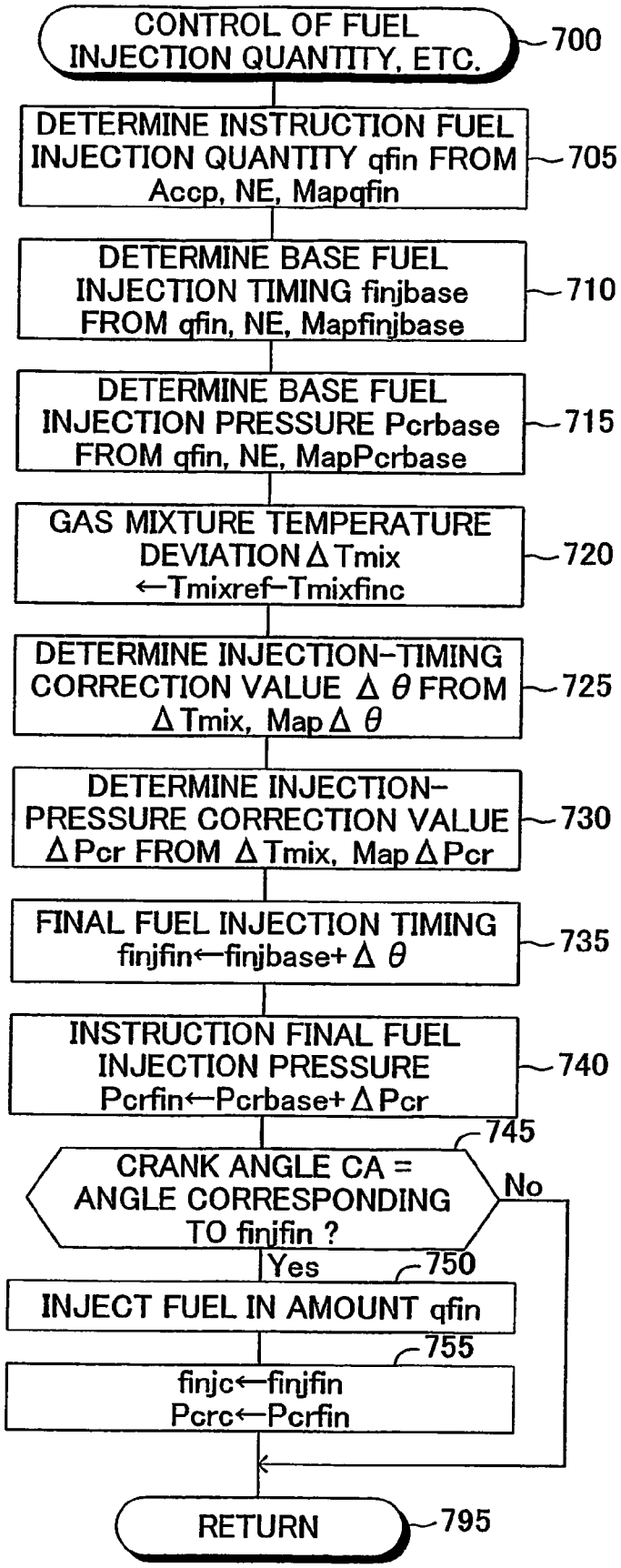
FIG. 7 is a flowchart showing a routine which the CPU shown in FIG. 1 executes so as to control fuel injection quantity, etc.
Figure 8:
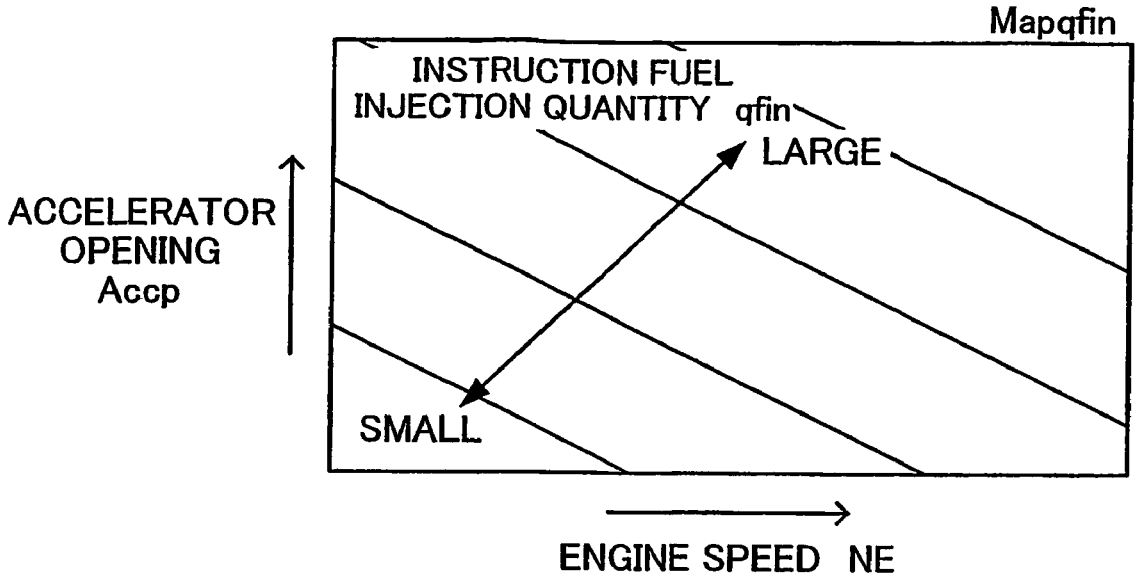
FIG. 8 is a table for determining an instruction fuel injection quantity, to which the CPU shown in FIG. 1 refers during execution of the routine shown in FIG. 7.

The CPU 61 repeatedly executes, at predetermined intervals, a routine shown by the flowchart of FIG. 7 and adapted to control fuel injection quantity, fuel injection timing, and fuel injection pressure. Therefore, when a predetermined timing has been reached, the CPU 61 starts the processing from step 700, and then proceeds to step 705 so as to obtain an accelerator opening Accp, an engine speed NE, and an instruction fuel injection quantity qfin from a table (map) Mapqfin shown in FIG. 8. The table Mapqfin defines the relation between accelerator opening Accp and engine speed NE, and instruction fuel injection quantity qfin; and is stored in the ROM 62.

Figure 9:
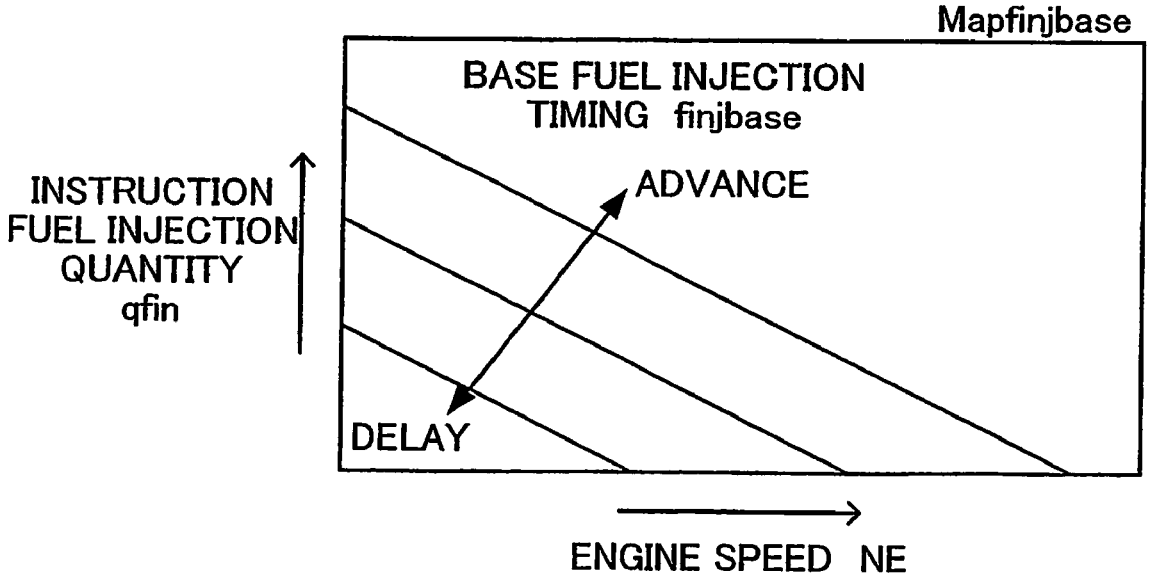
FIG. 9 is a table for determining a base fuel injection timing, to which the CPU shown in FIG. 1 refers during execution of the routine shown in FIG. 7.

Subsequently, the CPU 61 proceeds to step 710 so as to determine a base fuel injection timing finjbase from the instruction fuel injection quantity qfin, the engine speed NE, and a table Mapfinjbase shown in FIG. 9. The table Mapfinjbase defines the relation between instruction fuel injection quantity qfin and engine speed NE, and base fuel injection timing finjbase; and is stored in the ROM 62.

Figure 10:
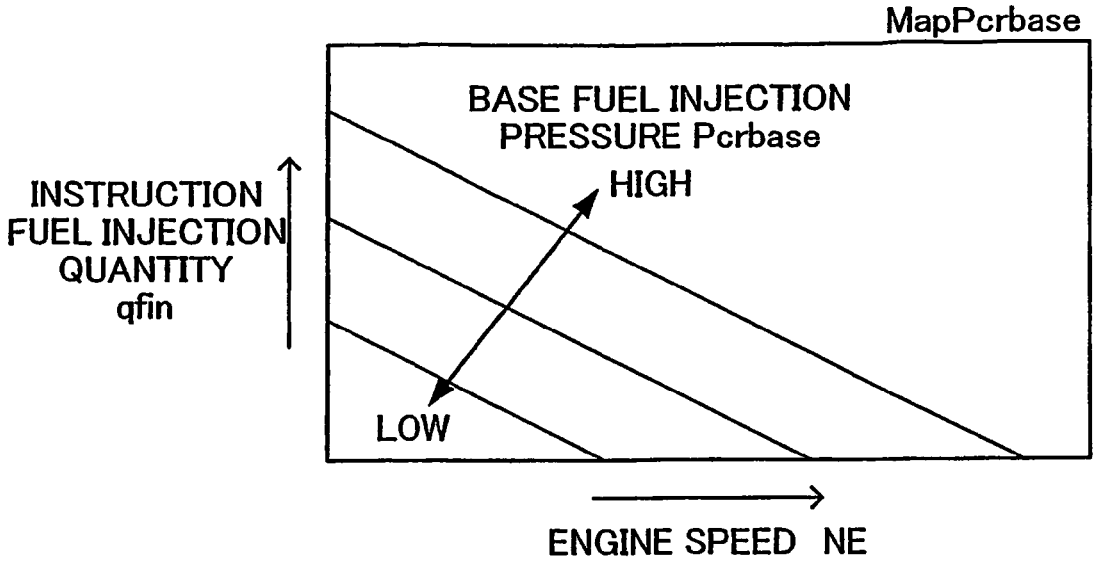
FIG. 10 is a table for determining a base fuel injection pressure, to which the CPU shown in FIG. 1 refers during execution of the routine shown in FIG. 7.

Subsequently, the CPU 61 proceeds to step 715 so as to determine a base fuel injection pressure Pcrbase from the instruction fuel injection quantity qfin, the engine speed NE, and a table MapPcrbase shown in FIG. 10. The table MapPcrbase defines the relation between instruction fuel injection quantity qfin and engine speed NE, and base fuel injection pressure Pcrbase; and is stored in the ROM 62.

Subsequently, the CPU 61 proceeds to step 720 so as to store, as a gas mixture temperature deviation ΔTmix, a value obtained through subtraction, from the target gas mixture temperature Tmixref, of the latest control-use final gas mixture temperature Tmixfinc, which is obtained for the previous fuel injection cylinder by a routine to be described later.

Figure 11:
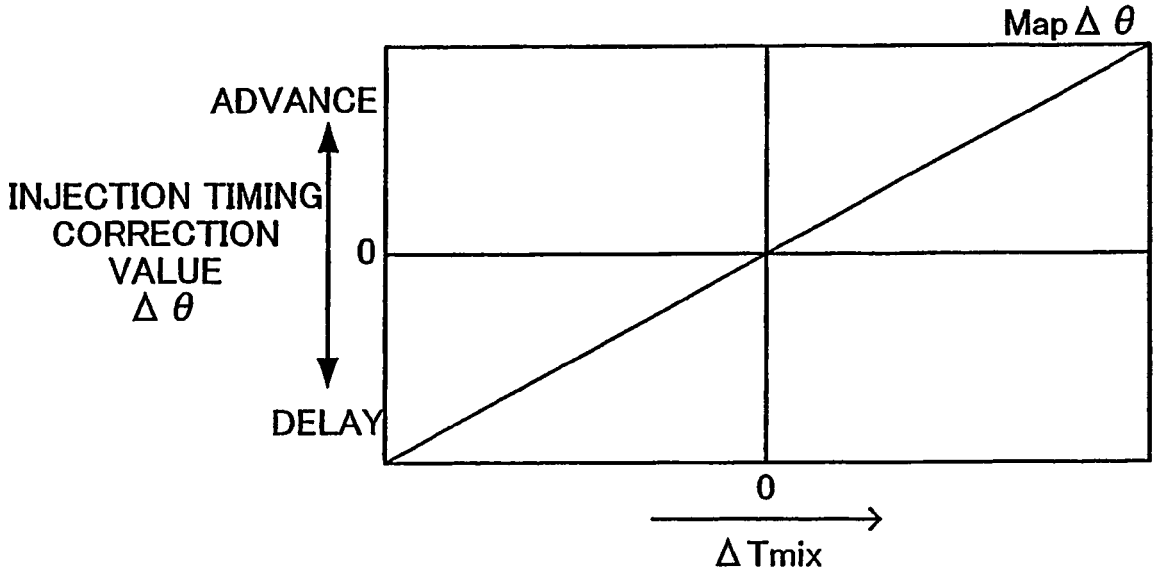
FIG. 11 is a table for determining an injection timing correction value, to which the CPU shown in FIG. 1 refers during execution of the routine shown in FIG. 7.

Subsequently, the CPU 61 proceeds to step 725 so as to determine an injection-timing correction value Δθ on the basis of the gas mixture temperature deviation ΔTmix and with reference to a table MapΔθ shown in FIG. 11. The table MapΔθ defines the relation between gas mixture temperature deviation ΔTmix and injection-timing correction value Δθ, and is stored in the ROM 62.

Figure 12:
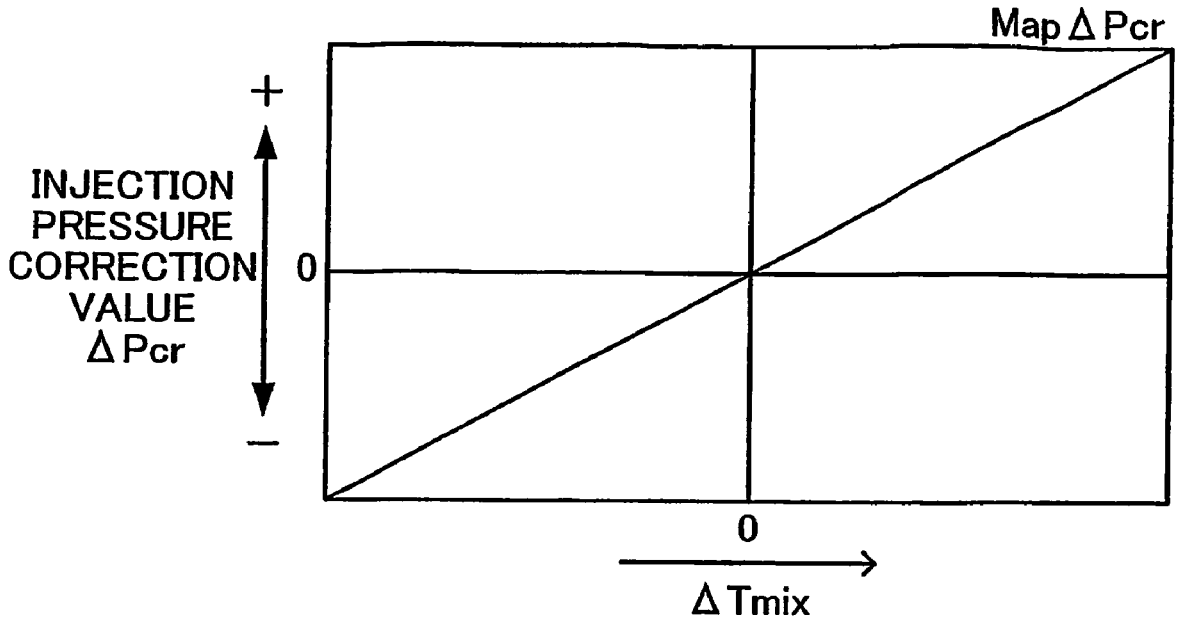
FIG. 12 is a table for determining an injection pressure correction value, to which the CPU shown in FIG. 1 refers during execution of the routine shown in FIG. 7.

After that, the CPU 61 proceeds to step 730 so as to determine an injection-pressure correction value ΔPcr on the basis of the gas mixture temperature deviation ΔTmix and with reference to a table MapΔPcr shown in FIG. 12. The table MapΔPcr defines the relation between gas mixture temperature deviation ΔTmix and injection-pressure correction value ΔPcr, and is stored in the ROM 62.

Next, the CPU 61 proceeds to step 735 so as to correct the base fuel injection timing finjbase by the injection-timing correction value Δθ to thereby obtain a final fuel injection timing finjfin. Thus, the fuel injection timing is corrected in accordance with the gas mixture temperature deviation ΔTmix. As is apparent from FIG. 11, when the gas mixture temperature deviation ΔTmix is positive, the injection-timing correction value Δθ becomes positive, and its magnitude increases with the magnitude of the gas mixture temperature deviation ΔTmix, whereby the final fuel injection timing finjfin is shifted toward the advance side. When the gas mixture temperature deviation ΔTmix is negative, the injection-timing correction value Δθ becomes negative, and its magnitude increases with the magnitude of the gas mixture temperature deviation ΔTmix, whereby the final fuel injection timing finjfin is shifted toward the delay side.

Subsequently, the CPU 61 proceeds to step 740 so as to correct the base fuel injection pressure Pcrbase by the injection-pressure correction value ΔPcr to thereby obtain an instruction final fuel injection pressure Pcrfin. Thus, the fuel injection pressure is corrected in accordance with the gas mixture temperature deviation ΔTmix. As is apparent from FIG. 12, when the gas mixture temperature deviation ΔTmix is positive, the injection-pressure correction value ΔPcr becomes positive, and its magnitude increases with the magnitude of the gas mixture temperature deviation ΔTmix, whereby the instruction final fuel injection pressure Pcrfin is shifted toward the high pressure side. When the gas mixture temperature deviation ΔTmix is negative, the injection-pressure correction value ΔPcr becomes negative, and its magnitude increases with the magnitude of the gas mixture temperature deviation ΔTmix, whereby the instruction final fuel injection pressure Pcrfin is shifted toward the low pressure side. As a result, the discharge pressure of the fuel injection pump 22 is controlled, whereby fuel pressurized to the determined instruction final fuel injection pressure Pcrfin is supplied to the fuel injection valves 21.

In step 745, the CPU 61 determines whether the crank angle CA at the present point in time coincides with an angle corresponding to the determined final fuel injection timing finjfin. When the CPU 61 makes a "Yes" determination in step 745, the CPU 61 proceeds to step 750 so as to cause the fuel injection valve 21 for the relevant fuel injection cylinder to inject the fuel pressurized to the determined instruction final fuel injection pressure Pcrfin in the determined instruction fuel injection quantity qfin. In step 755 subsequent to step 750, the CPU 61 stores the final fuel injection timing finjfin as control-use fuel injection timing finjc, and the instruction final fuel injection pressure Pcrfin as control-use fuel injection pressure Pcrc. After that, the CPU 61 proceeds to step 795 so as to end the current execution of the present routine. When the CPU 61 makes a "No" determination in step 745, the CPU 61 proceeds directly to step 795 so as to end the current execution of the present routine. Through the above-described processing, control of fuel injection quantity, fuel injection timing, and fuel injection pressure is achieved.

<Calculation of Various Physical Quantities at Injection Start Time>

Next, operation for calculating various physical quantities at fuel injection start time will be described. The CPU 61 repeatedly executes, at predetermined intervals, a routine shown by the flowchart of FIG. 13. Therefore, when a predetermined timing has been reached, the CPU 61 starts the processing from step 1300, and then proceeds to step 1305 so as to determine whether the crank angle CA at the present point in time coincides with ATDC-180° (i.e., whether the piston of the fuel injection cylinder is located at bottom dead center of the compression stroke).

The description will be continued under the assumption that the piston of the fuel injection cylinder has not reached bottom dead center of the compression stroke. In this case, the CPU 61 makes a "No" determination in step 1305, and proceeds to step 1315 so as to determine whether the crank angle CA at the present point in time coincides with the angle corresponding to the control-use fuel injection timing finjc set in the previously described step 755 (i.e., whether the present point in time is the fuel injection start time of the fuel injection cylinder).

At the present point in time, the piston has not reached bottom dead center of the compression stroke, and the fuel injection start time has not yet come. Therefore, the CPU 61 makes a "No" determination in step 1315, and proceeds directly to step 1395 so as to end the current execution of the present routine. After that, the CPU 61 repeatedly performs the processing of steps 1300, 1305, 1315, and 1395 until the piston of the fuel injection cylinder reaches bottom dead center of the compression stroke.

Next, the piston of the fuel injection cylinder is assumed to have reached bottom dead center of the compression stroke in this state. In this case, the CPU 61 makes a "Yes" determination when it proceeds to step 1305, and proceeds to step 1310 so as to store, as bottom-dead-center cylinder interior gas temperature Tbottom, an intake temperature Tb detected by means of the intake temperature sensor 72 at the present point in time, and so as store, as bottom-dead-center cylinder interior gas pressure Pbottom, an intake pipe pressure Pb detected by means of the intake pipe pressure sensor 73 at the present point in time. After making a "No" determination in step 1315, the CPU 61 proceeds directly to step 1395 so as to end the current execution of the present routine. After that, the CPU 61 repeatedly performs the processing of steps 1300, 1305, 1315, and 1395 until the fuel injection start time comes.

Next, the fuel injection start time is assumed to have come after elapse of a predetermined time. In this case, the CPU 61 makes a "Yes" determination when it proceeds to step 1315, and proceeds directly to step 1320 so as to start the processing for calculating various physical quantities at the fuel injection start time. In step 1320, the CPU 61 obtains the total mass Ma of cylinder interior gas in accordance with the above-mentioned Equation (5). At this time, the values set in step 1310 are used as values of Tbottom and Pbottom.

Subsequently, the CPU 61 proceeds to step 1325 so as to obtain a cylinder interior gas density ρa0 as measured at the fuel injection start time, on the basis of the total mass MA of the cylinder interior gas, the cylinder interior volume Va(CA) at the present point in time, and an equation described in the box of step 1325. Notably, since the crank angle CA at the present point in time coincides with the angle corresponding to the control-use fuel injection timing finjc, the cylinder interior volume Va(CA) at the present point in time is the above-mentioned cylinder interior volume Va0 at the fuel injection start time.

Subsequently, the CPU 61 proceeds to step 1330 so as to obtain a cylinder interior gas pressure Pa0 as measured at the fuel injection start time in accordance with an equation described in the box of step 1330 and corresponding to the above-described Equation (4), and then proceeds to step 1335 so as to set, as an effective injection pressure ΔP, a value obtained through subtraction of the cylinder interior gas pressure Pa0 from the control-use fuel injection pressure Pcrc set in the previously described step 755.

Next, the CPU 61 proceeds to step 1340 so as to obtain a fuel vapor temperature Tf in accordance with the above-described Equation (6). The fuel temperature detected by means of the fuel temperature sensor 76 at the present point in time is used as fuel temperature Tcr. Subsequently, the CPU 61 proceeds to step 1345 so as to determine a spray angle θ on the basis of the cylinder interior gas density ρa0, and the effective injection pressure ΔP, while referring to the above-described table Mapθ.

After that, the CPU 61 proceeds to step 1350 so as to initialize the above-mentioned post injection time t to "0," proceeds to step 1355 so as to initialize a combustion chamber wall arrival flag WALL to "0," and then proceeds to step 1395 so as to end the current execution of the present routine. The combustion chamber wall arrival flag WALL indicates that the above-mentioned gas mixture forefront portion has arrived at the combustion chamber wall surface when its value is "1," and indicates that the gas mixture forefront portion has not yet arrived at the combustion chamber wall surface when its value is "0." After that, the CPU 61 repeatedly performs the processing of steps 1300, 1305, 1315, and 1395 until the crank angle CA in relation to the fuel injection cylinder again coincides with ATDC-180° (i.e., until the piston of the fuel injection cylinder again reaches bottom dead center of the compression stroke). Through the above-described processing, various physical quantities at the fuel injection start time are calculated.

<Calculation of Mixture-Gas Temperature>

Figure 14:
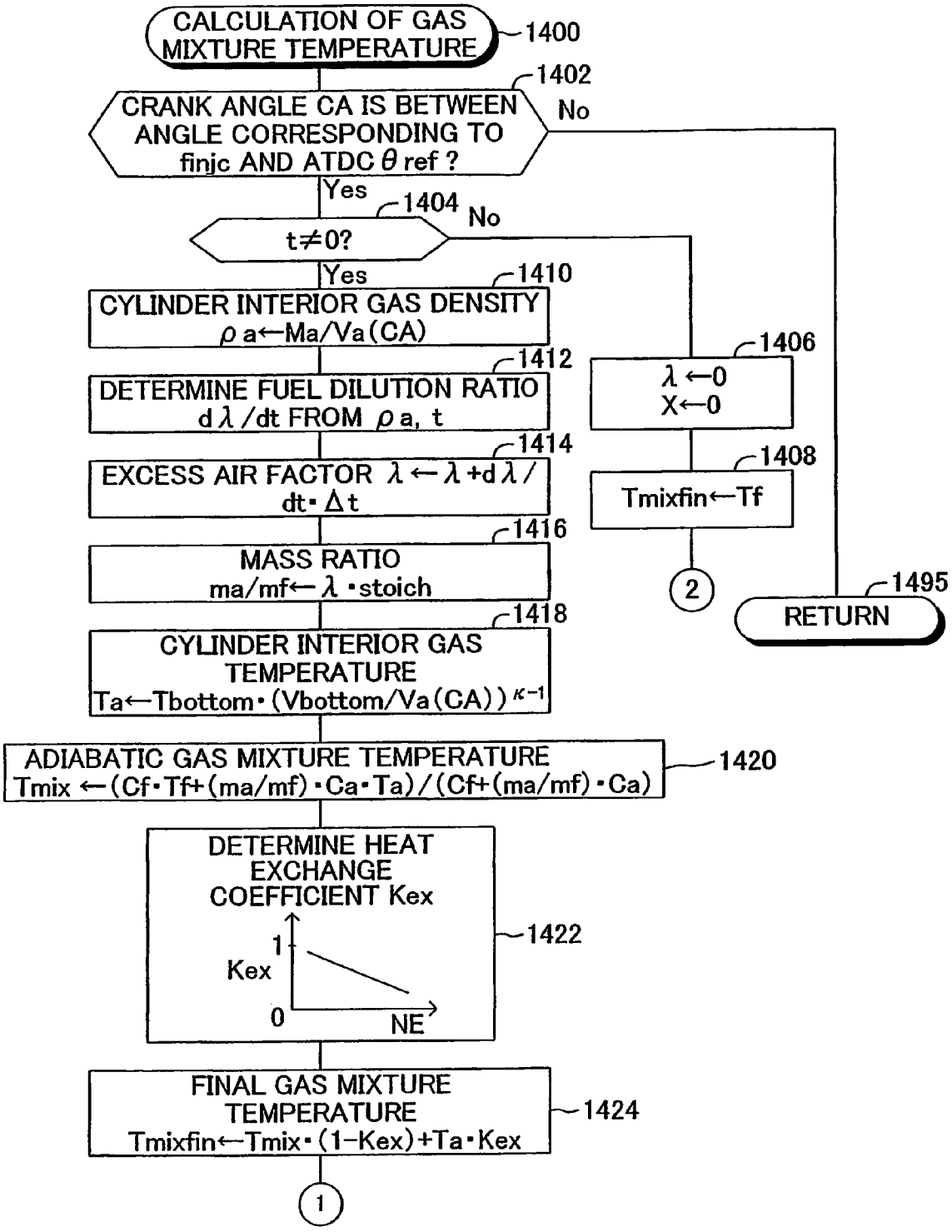
FIG. 14 is a flowchart showing the first half of a routine which the CPU shown in FIG. 1 executes so as to calculate gas mixture temperature.

Meanwhile, the CPU 61 repeatedly executes, at predetermined intervals, a routine shown by the flowcharts of FIGS. 14 and 15 and adapted to calculate gas mixture temperature. Therefore, when a predetermined timing has been reached, the CPU 61 starts the processing from step 1400, and then proceeds to step 1402 so as to determine whether the present crank angle CA falls between the angle corresponding to the above-mentioned control-use fuel injection timing finjc and the above-mentioned target ignition timing ATDCθref. When the CPU 61 makes a "No" determination in step 1402, the CPU 61 proceeds directly to step 1495 so as to end the current execution of the present routine.

Figure 13:
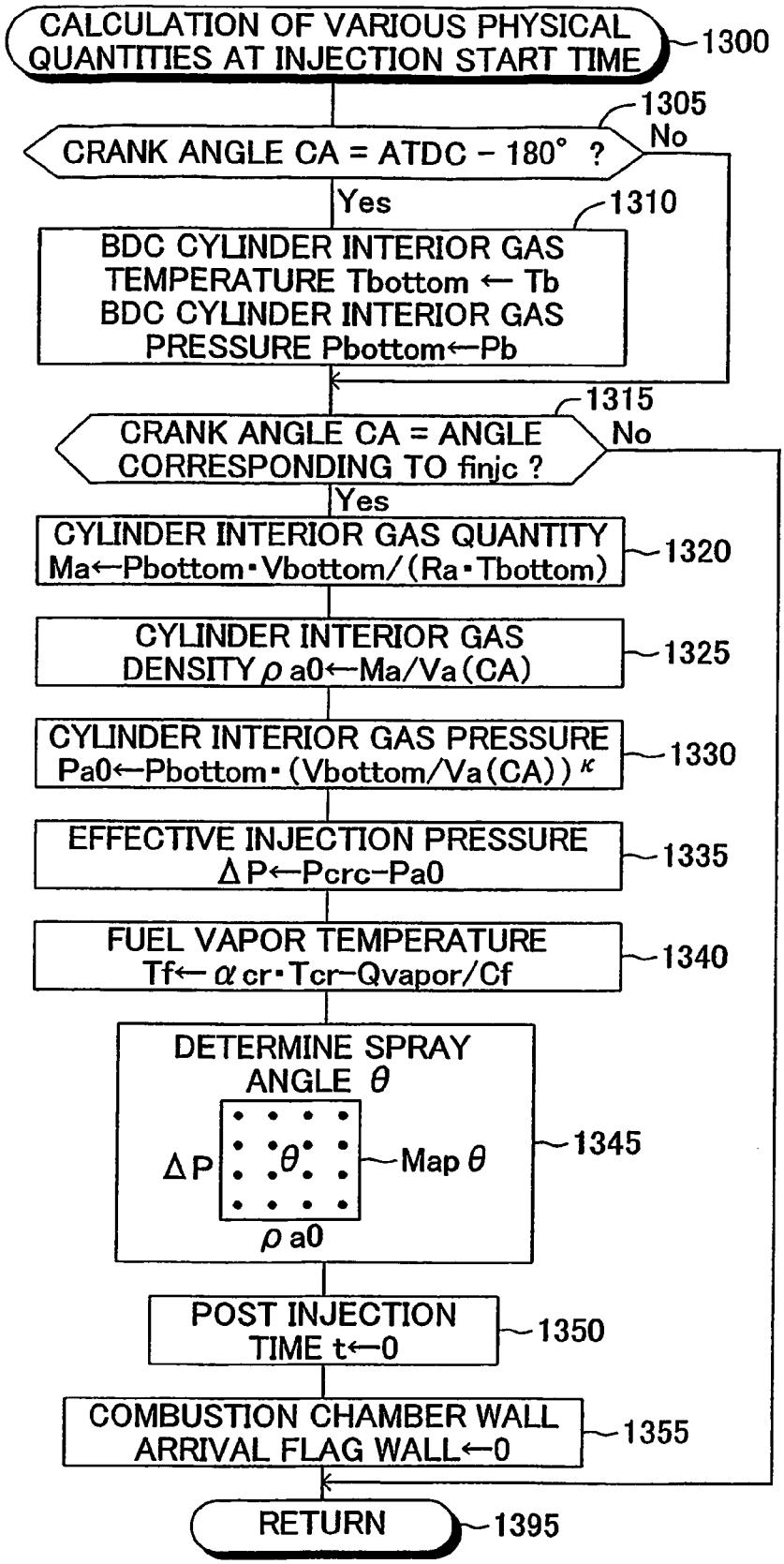
FIG. 13 is a flowchart showing a routine which the CPU shown in FIG. 1 executes so as to calculate various physical quantities at injection start time.

Now, it is assumed that the fuel injection start time has come and the present crank angle CA coincides with the angle corresponding to the above-mentioned control-use fuel injection timing finjc (accordingly, the present point in time is immediately after the performance of the processing of the previously described steps 1320 to 1355 of FIG. 13). In this case, the CPU 61 makes a "Yes" determination in step 1402, and proceeds directly to step 1404 so as to determine whether post injection time t is non-zero.

The present point in time is immediately after performance of the processing of the previously described step 1350, and post injection time t is "0" Therefore, the CPU 61 makes a "No" determination in step 1404, and proceeds to step 1406 so as to initialize the values of excess air factor λ and gas mixture travel distance X to "0". In step 1408 subsequent thereto, the CPU 61 stores, as final gas mixture temperature Tmixfin, the fuel vapor temperature Tf calculated in the previously described step 1340 of FIG. 13. After that, the CPU 61 proceeds to step 1438 of FIG. 15 so as to store, as a new post injection time t, a time obtained through addition of Δt to the present post injection time t ("0" at the present point in time). Subsequently, the CPU 61 proceeds to step 1495 so as to end the current execution of the present routine. Δt represents the intervals at which the present routine is performed.

As a result of the processing in step 1438, the present post injection time t becomes non-zero. Therefore, after this point in time, when the CPU 61 proceeds to step 1404 in the course of repeated execution of the present routine, the CPU 61 makes a "Yes" determination, and then proceeds to step 1410. In step 1410, the CPU 61 obtains the present value of cylinder interior gas density ρa on the basis of the total mass Ma of the cylinder interior gas obtained in the previously described step 1320 of FIG. 13, the present value of cylinder interior volume Va(CA), and an equation described in the box of step 1410.

Subsequently, the CPU 61 proceeds to step 1412 so as to obtain a fuel dilution ratio dλ/dt on the basis of the above-mentioned cylinder interior gas density ρa, the present post injection time t, and the above-mentioned Equation (3), and then proceeds to step 1414 so as to obtain the present value of excess air factor λ through integrating the fuel dilution ratio dλ/dt with time in accordance with the above-mentioned Equation (2). The values calculated in steps 1335 and 1345 of FIG. 13, respectively, are used as values of effective injection pressure ΔP and spray angle θ in the above-mentioned Equation (3).

Subsequently, the CPU 61 proceeds to step 1416 so as to obtain a mass ratio (ma/mf) on the basis of the present value of excess air factor λ and in accordance with the equation based on the above-mentioned Equation (1) and described in the box of step 1416. In step 1418 subsequent thereto, the CPU 61 obtains the present value of cylinder interior gas temperature Ta on the basis of the present value of cylinder interior volume Va(CA) and the above-mentioned Equation (7). In step 1420 subsequent thereto, the CPU 61 obtains a value of adiabatic gas mixture temperature Tmix on the basis of the value of mass ratio (ma/mf), the value of cylinder interior gas temperature Ta, and the value of fuel vapor temperature Tf obtained in step 1340 of FIG. 13 and in accordance with the above-mentioned Equation (9).

Subsequently, the CPU 61 proceeds to step 1422 so as to obtain a value of heat exchange coefficient Kex on the basis of a value of engine speed NE obtained from output of the crank position sensor 74 and with reference to a table described in the box of step 1422, and then proceeds to step 1424 so as to obtain the present value of final gas mixture temperature Tmixfin on the basis of the value of heat exchange coefficient Kex, the value of adiabatic gas mixture temperature Tmix, and the value of cylinder interior gas temperature Ta, and in accordance with the above-mentioned Equation (10).

Subsequently, the CPU 61 proceeds to step 1426 of FIG. 15 so as to determine whether the value of the combustion chamber wall arrival flag WALL is "0." At the present point in time, the value of the combustion chamber wall arrival flag WALL is "0," because of the processing of the previously described step 1355. Therefore, the CPU 61 makes a "Yes" determination in step 1426 and then proceeds to step 1428 so as to obtain a value of combustion chamber wall distance Xwall on the basis of the control-use fuel injection timing finjc set in the previously described step 755 of FIG. 7 and the present crank angle CA detected by means of the crank position sensor 74 and in accordance with a function f for determining combustion chamber wall distance Xwall while using these values as arguments.

Next, the CPU 61 proceeds to step 1430 so as to obtain a gas mixture moving speed dX/dt on the basis of the value of cylinder interior gas density ρa obtained in step 1410 and the present post injection time t and in accordance with the above-mentioned Equation (12), and then proceeds to step 1432 so as to obtain the present value of gas mixture travel distance X by integrating with respect to time the gas mixture moving speed dX/dt in accordance with the above-mentioned Equation (11). The values calculated in steps 1335 and 1345 of FIG. 13, respectively, are used as values of effective injection pressure ΔP and spray angle θ in Equation (12).

Subsequently, the CPU 61 proceeds to 1434 so as to determine whether the present value of gas mixture travel distance X is not less than the value of combustion chamber wall distance Xwall (i.e., whether the above-mentioned gas mixture forefront portion has arrived at the combustion chamber wall surface). Description will be continued under the assumption that the gas mixture forefront portion has not yet arrived at the combustion chamber wall surface, and the crank angle CA has not yet reached the above-mentioned target ignition timing ATDCθref. In this case, the CPU 61 makes a "No" determination in step 1434, and then proceeds directly to step 1436 so as to determine whether the crank angle CA coincides with the target ignition timing ATDCθref.

Since at the present point in time the crank angle CA has not yet reached the target ignition timing ATDCθref, the CPU 61 makes a "No" determination in step 1436, proceeds to step 1438 so as to increase the value of post injection time t by Δt, and then proceeds to step 1495 so as to end the current execution of the present routine. After that, so long as the gas mixture forefront portion has not yet arrived at the combustion chamber wall surface, and the crank angle CA has not yet reached the target ignition timing ATDCθref, the CPU 61 repeatedly performs the processing of steps 1400 to 1404, 1410 to 1434, 1436, and 1438, to thereby repeatedly update the value of final gas mixture temperature Tmixfin in step 1424.

Next, there will be described the case where the crank angle CA has reached the target ignition timing ATDCθref before the gas mixture forefront portion arrives at the combustion chamber wall surface. In this case, the CPU 61 makes a "Yes" determination when it proceeds to step 1436, and then proceeds to step 1440 so as to store, as the above-mentioned control-use final gas mixture temperature Tmixfinc, the present value of final gas mixture temperature Tmixfin calculated in step 1424. After that, the CPU 61 proceeds via step 1438 to step 1495 so as to end the current execution of the present routine. After this point of time, the CPU 61 repeats an operation of making a "No" determination in step 1402 and proceeding directly to step 1495 so as to end the current execution of the present routine.

The value of control-use final gas mixture temperature Tmixfinc set in step 1440 is used in the processing in step 720 of the routine of FIG. 7 when the routine is executed for the fuel injection cylinder at the next timing. As a result, the fuel injection timing, etc. are feedback-controlled in such a manner that the next timing of ignition of gas mixture within the fuel injection cylinder coincides with the target ignition timing ATDCθref.

Next, there will be described the case where the above-mentioned state in which "the gas mixture forefront portion has not yet arrived at the combustion chamber wall surface, and the crank angle CA has not yet reached the target ignition timing ATDCθref" has changed to a state in which the gas mixture forefront portion has arrived at the combustion chamber wall surface before the crank angle CA reaches the target ignition timing ATDCθref. In this case, the CPU 61 makes a "Yes" determination when it proceeds to step 1434, and then performs the processing in step 1442 and steps subsequent thereto.

In step 1442, the CPU 61 obtains a value of combustion chamber wall surface temperature Twall on the basis of the present engine speed NE and the present output torque T detected by means of the output torque sensor 77, while referring to a table MapTwall described in the box of step 1442. Subsequently, the CPU 61 proceeds to step 1444 so as to obtain a heat exchange coefficient Kexwall on the basis of the present engine speed NE and the control-use fuel injection pressure Pcrc set in the previously described step 755 of FIG. 7, while referring to a table MapKexwall described in the box of step 1444.

Subsequently, the CPU 61 proceeds to step 1446 so as to obtain a value of wall surface heat transfer quantity Qwall on the basis of the value of final gas mixture temperature Tmixfin calculated in step 1424 of FIG. 14 and the value of combustion chamber wall surface temperature Twall obtained in step 1442, and the heat exchange coefficient Kexwall, and in accordance with the above-mentioned Equation (13).

The CPU 61 then proceeds to step 1448 so as to obtain a new value of final gas mixture temperature Tmixfin (corrects the value of final gas mixture temperature Tmixfin calculated in step 1424) on the basis of the value of final gas mixture temperature Tmixfin calculated in step 1424 of FIG. 14 and the value of wall surface heat transfer quantity Qwall, and in accordance with the above-mentioned Equation (14). In step 1450 subsequent thereto, the CPU 61 sets the value of the combustion chamber wall arrival flag WALL to "1." After making a "No" determination in step 1436 subsequent thereto, the CPU 61 proceeds to step 1438, and then to step 1495 so as to end the current execution of the present routine.

After this point, since the value of the combustion chamber wall arrival flag WALL is maintained at "1," the CPU 61 makes a "No" determination in step 1426 after passing through steps 1400 to 1404, 1410 to 1424, and then proceeds to step 1452. In step 1452, as in step 1448, the CPU 61 corrects the value of final gas mixture temperature Tmixfin calculated in step 1424 by a temperature drop amount corresponding to the value of wall surface heat transfer quantity Qwall obtained in step 1446.

After this point, so long as the crank angle CA has not yet reached the target ignition timing ATDCθref, the CPU 61 repeatedly performs the processing of steps 1400 to 1404, 1410 to 1426, 1452, 1436, 1438, and 1495.

Here, the crank angle CA is assumed to have reached the target ignition timing ATDCθref after elapse of a certain period of time. In this case, the CPU 61 makes a "Yes" determination when it proceeds to 1436, and then proceeds to step 1440 so as to store, as the above-mentioned control-use final gas mixture temperature Tmixfinc, the present value of final gas mixture temperature Tmixfin corrected in step 1452. After this point of time, the CPU 61 repeats an operation of making a "No" determination in step 1402 and proceeding directly to step 1495 so as to end the current execution of the present routine. The value of control-use final gas mixture temperature Tmixfinc in this case is also used in the processing in step 720 of the routine of FIG. 7 when the routine is executed for the fuel injection cylinder at the next timing.

In the above-described manner, the temperature of gas mixture (specifically, final gas mixture temperature Tmixfin of a gas mixture forefront portion) is repeatedly obtained at predetermined intervals, and the fuel injection timing and fuel injection pressure of the engine are feedback-controlled on the basis of the value of final gas mixture temperature Tmixfin at the target ignition timing ATDCθref.

As described above, in the embodiment of the engine control apparatus according to the present invention, cylinder interior gas is handled as a combination of mixing-gas-forming cylinder interior gas which mixes with injected fuel vapor and a peripheral cylinder interior gas present around the produced gas mixture; and the temperature of the gas mixture is estimated by making use of peripheral cylinder interior gas temperature Ta and adiabatic gas mixture temperature Tmix, which is calculated on the basis of the heat quantity of the injected fuel vapor and the heat quantity of the mixing-gas-forming cylinder interior gas. Since the temperature of the gas mixture is estimated in consideration of heat that the gas mixture receives from the peripheral cylinder interior gas, which is higher in temperature than the gas mixture, the temperature of the gas mixture can be estimated accurately.

The present invention is not limited to the above-described embodiment, and may be modified in various manners within the scope of the present invention. For example, the following modifications may be employed. In the above-described embodiment, gas mixture temperature (final gas mixture temperature Tmixfin) is repeatedly obtained during a period between the injection start time and the target ignition timing ATDCθref. However, the present apparatus may be configured to obtain gas mixture temperature only at the target ignition timing ATDCθref.

In the above-described embodiment, after gas mixture (its forefront portion) hits the combustion chamber wall surface, a value of final gas mixture temperature Tmixfin is obtained from adiabatic gas mixture temperature Tmix and peripheral cylinder interior gas temperature Ta, and the value of final gas mixture temperature Tmixfin is corrected by an amount corresponding to heat transferred to the combustion chamber wall. However, the present apparatus may be configured to obtain a value of adiabatic gas mixture temperature Tmix, correct the value of adiabatic gas mixture temperature Tmix by an amount corresponding to heat transferred to the combustion chamber wall, and then obtain a value of final gas mixture temperature Tmixfin from the corrected value of adiabatic gas mixture temperature Tmix and peripheral cylinder interior gas temperature Ta.

In the above-described embodiment, a value of final gas mixture temperature Tmixfin is estimated on the basis of adiabatic gas mixture temperature Tmix, peripheral cylinder interior gas temperature Ta, and heat exchange coefficient Kex, and in accordance with the above-mentioned Equation (10) (see step 1424 of FIG. 14). However, the present apparatus may be configured to obtain a quantity of heat transferred from the peripheral cylinder interior gas to the gas mixture on the basis of a deviation between peripheral cylinder interior gas temperature Ta and adiabatic gas mixture temperature Tmix, and correct the adiabatic gas mixture temperature Tmix by an amount corresponding to the quantity of transferred heat to thereby obtain the value of final gas mixture temperature Tmixfin.

The invention claimed is:

1. A gas mixture state-quantity estimation method for an internal combustion engine, comprising estimating a state quantity of a gas mixture composed of fuel injected into a cylinder of the engine and a portion of cylinder interior gas which is present within the cylinder on the basis of:

state-quantity of the injected fuel, state-quantity of the portion of cylinder interior gas, and heat transferred to the gas mixture from a remaining portion of the cylinder interior gas, wherein said remaining portion of the cylinder interior gas is cylinder interior gas that is present around the gas mixture without mixing with the fuel.

2. A gas mixture temperature estimation method for an internal combustion engine, comprising:

estimating a temperature of a gas mixture composed of fuel injected into a cylinder of the engine and a portion of cylinder interior gas which is present within the cylinder on the basis of:

heat quantity of the injected fuel, heat quantity of the portion of cylinder interior gas, and heat transferred to the gas mixture from a remaining portion of the cylinder interior gas, wherein said remaining portion of the cylinder interior gas is cylinder interior gas that is present around the gas mixture without mixing with the fuel.

3. A gas mixture temperature estimation method for an internal combustion engine, comprising:

calculating an adiabatic gas mixture temperature of a gas mixture composed of fuel injected into a cylinder of the engine and a portion of cylinder interior gas which is present within the cylinder the calculation being performed on the basis of heat quantity of the injected fuel and heat quantity of the portion of cylinder interior gas, and under the assumption that heat exchange with the outside does not occur in the course of the fuel mixing with the portion of cylinder interior gas; and estimating the temperature of the gas mixture by use of the calculated adiabatic gas mixture temperature and temperature of the cylinder interior gas.

4. A gas mixture temperature estimation method for an internal combustion engine according to claim 2, wherein after the gas mixture hits a combustion chamber wall, a temperature of the gas mixture is estimated in consideration of heat transferred from the gas mixture to the combustion chamber wall.

5. A gas mixture temperature estimation method for an internal combustion engine according to claim 3, wherein after the gas mixture hits a combustion chamber wall, a temperature of the gas mixture is estimated in consideration of heat transferred from the gas mixture to the combustion chamber wall.

6. A gas mixture temperature obtaining apparatus for an internal combustion engine, wherein said apparatus is configured to obtain a temperature of a gas mixture composed of fuel injected into a cylinder of the engine and a portion of cylinder interior gas which is present within the cylinder on the basis of:

heat quantity of the injected fuel, heat quantity of the portion of cylinder interior gas, and heat transferred to the gas mixture from a remaining portion of the cylinder interior gas, wherein said remaining portion of the cylinder interior gas is cylinder interior gas that is present around the gas mixture without mixing with the fuel.

7. A control apparatus for an internal combustion engine, comprising:

a control for changing an engine control parameter; and a gas mixture temperature obtaining apparatus for an internal combustion engine;

wherein:

said gas mixture temperature obtaining apparatus is configured to obtain a temperature of a gas mixture composed of fuel injected into a cylinder of the engine and a portion of cylinder interior gas which is present within the cylinder; and said control for changing an engine control parameter is configured to change an engine control parameter in accordance with the temperature of the gas mixture obtained by the gas mixture temperature obtaining apparatus.

8. A control apparatus for an internal combustion engine according to claim 7, wherein the engine control parameter includes at least one of fuel injection timing, fuel injection pressure, fuel injection quantity, EGR valve opening, and throttle valve opening.

* * * * *